US010290946B2

(12) United States Patent
Romano et al.

(10) Patent No.: US 10,290,946 B2
(45) Date of Patent: May 14, 2019

(54) HYBRID ELECTRONIC DEVICE ANTENNAS HAVING PARASITIC RESONATING ELEMENTS

(71) Applicant: Apple Inc., Cupertino, CA (US)

(72) Inventors: Pietro Romano, Mountain View, CA (US); Harish Rajagopalan, San Jose, CA (US); Umar Azad, San Jose, CA (US); Lu Zhang, West Lafayette, IN (US); Rodney A. Gomez Angulo, Sunnyvale, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 201 days.

(21) Appl. No.: 15/274,328

(22) Filed: Sep. 23, 2016

(65) Prior Publication Data

US 2018/0090847 A1 Mar. 29, 2018

(51) Int. Cl.
*H01Q 1/24* (2006.01)
*H01Q 5/30* (2015.01)
(Continued)

(52) U.S. Cl.
CPC ..... *H01Q 13/10* (2013.01); *H01Q 1/241* (2013.01); *H01Q 1/243* (2013.01); *H01Q 1/48* (2013.01); *H01Q 5/328* (2015.01); *H01Q 5/385* (2015.01); *H01Q 9/0414* (2013.01); *H01Q 9/285* (2013.01); *H01Q 13/16* (2013.01); *H01Q 13/18* (2013.01)

(58) Field of Classification Search
CPC ..... H01Q 5/30; H01Q 5/307; H01Q 5/314; H01Q 5/328; H01Q 5/342; H01Q 5/357;
(Continued)

(56) References Cited

U.S. PATENT DOCUMENTS 4,016,490 A 4/1977 Weckenmann et al.
4,614,937 A 9/1986 Poujois
(Continued)

FOREIGN PATENT DOCUMENTS

CN 1343380 4/2002
CN 1543010 11/2004
(Continued)

OTHER PUBLICATIONS

Myllmaki et al., "Capacitive recognition of the user's hand grip position in mobile handsets", Progress in Electromagnetics Research B, vol. 22, 2010, pp. 203-220.
(Continued)

*Primary Examiner* — Jessica Han
*Assistant Examiner* — Patrick R Holecek
(74) *Attorney, Agent, or Firm* — Treyz Law Group, P.C.; Michael H. Lyons; Tianyi He

(57) ABSTRACT

An electronic device may have a hybrid antenna that includes a slot resonating element formed from a slot in a ground plane and a planar resonating element formed over the slot. A parasitic element may be disposed over the planar element. A switch may couple the parasitic element to the ground. A tunable circuit may couple the planar element to the ground. The switch and tunable circuit may be placed in different tuning states. In a first state, the tunable circuit and switch form open circuits. In a second state, the tunable circuit may an open circuit and the switch is closed. In a third state, the tunable circuit forms a return path and the switch forms an open circuit. This may allow the antenna to operate with satisfactory efficiency in low, mid, and high bands despite volume constraints imposed on the antenna.

20 Claims, 10 Drawing Sheets

(51) Int. Cl.

| | |
|---|---|
| ***H01Q 13/10*** | (2006.01) |
| ***H01Q 1/48*** | (2006.01) |
| ***H01Q 9/28*** | (2006.01) |
| ***H01Q 9/04*** | (2006.01) |
| ***H01Q 13/16*** | (2006.01) |
| ***H01Q 13/18*** | (2006.01) |
| ***H01Q 5/328*** | (2015.01) |
| ***H01Q 5/385*** | (2015.01) |

(58) Field of Classification Search

CPC ..... H01Q 5/364; H01Q 5/371; H01Q 5/378; H01Q 5/392; H01Q 5/40; H01Q 1/22; H01Q 1/2258; H01Q 1/2266; H01Q 1/24; H01Q 1/241; H01Q 1/242; H01Q 1/243; H01Q 1/245; H01Q 13/10; H01Q 13/103; H01Q 13/106; H01Q 13/16; H01Q 9/0407; H01Q 9/0414; H01Q 9/0421

See application file for complete search history.

(56) References Cited

U.S. PATENT DOCUMENTS 4,835,538 A * 5/1989 McKenna ..... H01Q 9/0414 343/700 MS
5,337,353 A 8/1994 Boie et al.
5,410,497 A 4/1995 Viletto
5,463,406 A 10/1995 Vannatta et al.
5,650,597 A 7/1997 Redmayne
5,826,458 A 10/1998 Little
5,854,972 A 12/1998 Pennock et al.
5,864,316 A 1/1999 Bradley et al.
5,905,467 A 5/1999 Narayanaswamy et al.
5,905,487 A 5/1999 Kwon
5,956,626 A 9/1999 Kashke et al.
6,181,281 B1 1/2001 Desclos
6,301,489 B1 10/2001 Winstead et al.
6,329,958 B1 12/2001 McLean et al.
6,380,899 B1 4/2002 Madsen et al.
6,380,903 B1 4/2002 Hayes et al.
6,408,193 B1 6/2002 Katagishi et al.
6,445,906 B1 9/2002 Nguyen et al.
6,456,856 B1 9/2002 Werling et al.
6,480,162 B2 11/2002 Sabet
6,529,088 B2 3/2003 Lafleur et al.
6,590,539 B2 7/2003 Shinichi
6,611,227 B1 8/2003 Nebiyeloul-Kifle et al.
6,657,595 B1 12/2003 Phillips et al.
6,678,532 B1 1/2004 Mizoguchi
6,741,214 B1 5/2004 Kadambi et al.
6,765,536 B2 7/2004 Phillips et al.
6,788,266 B2 9/2004 St. Hillaire
6,879,293 B2 4/2005 Sato
6,975,276 B2 12/2005 Brown
6,978,121 B1 12/2005 Lane et al.
6,985,108 B2 1/2006 Mikkola
6,985,113 B2 1/2006 Nishimura et al.
7,016,686 B2 3/2006 Spaling
7,039,435 B2 5/2006 McDowell et al.
7,050,010 B2 5/2006 Wang et al.
7,109,945 B2 9/2006 Mori
7,113,087 B1 9/2006 Casebolt
7,146,139 B2 12/2006 Nevermann
7,221,092 B2 5/2007 Anzai et al.
7,356,361 B1 4/2008 Hawkins et al.
7,388,550 B2 6/2008 McLean
7,499,722 B2 3/2009 McDowell et al.
7,502,221 B2 3/2009 Fuller et al.
7,522,846 B1 4/2009 Lewis et al.
7,538,760 B2 5/2009 Hotelling et al.
7,551,142 B1 6/2009 Zhang et al.
7,557,760 B2 7/2009 Chang et al.
7,595,788 B2 9/2009 Son
7,633,076 B2 12/2009 Huppi et al.
7,663,612 B2 2/2010 Bladt
7,683,840 B2 * 3/2010 Lin ..... H01Q 1/243 343/702
7,705,787 B2 4/2010 Ponce De Leon
7,826,875 B2 11/2010 Karaoguz et al.
7,834,813 B2 11/2010 Caimi et al.
7,864,123 B2 1/2011 Hill et al.
7,876,274 B2 1/2011 Hobson et al.
7,999,748 B2 8/2011 Lightenberg et al.
8,059,039 B2 11/2011 Ayala Vazquez et al.
8,059,040 B2 11/2011 Ayala Vazquez et al.
8,115,753 B2 2/2012 Newton
8,159,399 B2 4/2012 Dorsey et al.
8,228,198 B2 7/2012 McAllister
8,238,971 B2 8/2012 Terlizzi
8,255,009 B2 8/2012 Sorenson et al.
8,270,914 B2 9/2012 Pascolini et al.
8,319,692 B2 11/2012 Chiang et al.
8,325,094 B2 12/2012 Ayala Vazquez et al.
8,326,221 B2 12/2012 Dorsey et al.
8,347,014 B2 1/2013 Schubert et al.
8,368,602 B2 2/2013 Hill
8,417,296 B2 4/2013 Caballero et al.
8,432,322 B2 4/2013 Amm et al.
8,436,816 B2 5/2013 Leung et al.
8,466,839 B2 6/2013 Schlub et al.
8,497,806 B2 7/2013 Lai
8,517,383 B2 8/2013 Wallace et al.
8,525,734 B2 9/2013 Krogerus
8,531,337 B2 9/2013 Soler Castany et al.
8,577,289 B2 11/2013 Schlub et al.
8,610,629 B2 12/2013 Pascolini et al.
8,638,266 B2 1/2014 Liu
8,638,549 B2 1/2014 Garelli et al.
8,648,752 B2 2/2014 Ramachandran et al.
8,674,889 B2 3/2014 Bengtsson et al.
8,749,523 B2 6/2014 Pance et al.
8,781,420 B2 7/2014 Schlub et al.
8,798,554 B2 8/2014 Darnell et al.
8,836,587 B2 9/2014 Darnell et al.
8,872,706 B2 10/2014 Caballero et al.
8,896,488 B2 11/2014 Ayala Vazquez et al.
8,947,302 B2 2/2015 Caballero et al.
8,947,305 B2 2/2015 Amm et al.
8,952,860 B2 2/2015 Li et al.
8,963,782 B2 2/2015 Ayala Vazquez et al.
8,963,783 B2 2/2015 Vin et al.
8,963,784 B2 2/2015 Zhu et al.
9,024,823 B2 5/2015 Bevelacqua
9,035,833 B2 5/2015 Zhang
9,093,752 B2 7/2015 Yarga et al.
9,153,874 B2 10/2015 Ouyang et al.
9,257,750 B2 2/2016 Vazquez et al.
9,276,319 B2 3/2016 Vazquez et al.
9,293,828 B2 3/2016 Bevelacqua et al.
9,300,342 B2 3/2016 Schlub et al.
9,331,397 B2 5/2016 Jin et al.
9,337,537 B2 5/2016 Hu et al.
9,356,356 B2 * 5/2016 Chang ..... H01Q 1/243
9,379,445 B2 * 6/2016 Zhu ..... H01Q 13/10
9,450,289 B2 9/2016 Guterman et al.
9,502,775 B1 * 11/2016 Gummalla ..... H01Q 9/14
2002/0015024 A1 2/2002 Westerman et al.
2002/0027474 A1 3/2002 Bonds
2002/0060645 A1 5/2002 Shinichi
2002/0094789 A1 7/2002 Harano
2002/0123309 A1 9/2002 Collier et al.
2003/0062907 A1 4/2003 Nevermann
2003/0186728 A1 10/2003 Manjo
2003/0193438 A1 10/2003 Yoon
2003/0197597 A1 10/2003 Bahl et al.
2003/0210203 A1 11/2003 Phillips et al.
2003/0218993 A1 11/2003 Moon et al.
2004/0051670 A1 3/2004 Sato
2004/0080457 A1 4/2004 Guo et al.
2004/0104853 A1 6/2004 Chen
2004/0176083 A1 9/2004 Shiao et al.
2004/0189542 A1 9/2004 Mori
2004/0222926 A1 11/2004 Kontogeorgakis et al.
2004/0239575 A1 12/2004 Shoji

(56) References Cited

U.S. PATENT DOCUMENTS

| | | | |
|---|---|---|---|
| 2005/0146475 | A1 | 7/2005 | Bettner |
| 2005/0168384 | A1 | 8/2005 | Wang et al. |
| 2005/0245204 | A1 | 11/2005 | Vance |
| 2005/0264466 | A1 | 12/2005 | Hibino et al. |
| 2006/0001576 | A1 | 1/2006 | Contopanagos |
| 2006/0152497 | A1 | 7/2006 | Rekimoto |
| 2006/0161871 | A1 | 7/2006 | Hotelling et al. |
| 2006/0232468 | A1 | 10/2006 | Parker et al. |
| 2006/0244663 | A1 | 11/2006 | Fleck et al. |
| 2006/0248363 | A1 | 11/2006 | Chen et al. |
| 2006/0274493 | A1 | 12/2006 | Richardson et al. |
| 2006/0278444 | A1 | 12/2006 | Binstead |
| 2007/0120740 | A1 | 5/2007 | Iellici et al. |
| 2007/0126711 | A1 | 6/2007 | Oshita |
| 2007/0188375 | A1 | 8/2007 | Richards et al. |
| 2007/0239921 | A1 | 10/2007 | Toorains et al. |
| 2008/0165063 | A1 | 7/2008 | Schlub et al. |
| 2008/0246735 | A1 | 10/2008 | Reynolds et al. |
| 2008/0248837 | A1 | 10/2008 | Kunkel |
| 2008/0297487 | A1 | 12/2008 | Hotelling et al. |
| 2008/0309836 | A1 | 12/2008 | Sakama et al. |
| 2008/0316120 | A1 | 12/2008 | Hirota et al. |
| 2009/0000023 | A1 | 1/2009 | Wegelin et al. |
| 2009/0058735 | A1 | 3/2009 | Hill et al. |
| 2009/0096683 | A1 | 4/2009 | Rosenblatt et al. |
| 2009/0128435 | A1 | 5/2009 | Jeng |
| 2009/0153407 | A1 | 6/2009 | Zhang |
| 2009/0153410 | A1 | 6/2009 | Chiang |
| 2009/0174611 | A1 | 7/2009 | Schlub et al. |
| 2009/0256757 | A1 | 10/2009 | Chiang |
| 2009/0256758 | A1 | 10/2009 | Schlub et al. |
| 2009/0295648 | A1 | 12/2009 | Dorsey et al. |
| 2010/0062728 | A1 | 3/2010 | Black et al. |
| 2010/0079351 | A1 | 4/2010 | Huang et al. |
| 2010/0081374 | A1 | 4/2010 | Moosavi |
| 2010/0109971 | A2 | 5/2010 | Gummalla et al. |
| 2010/0167672 | A1 | 7/2010 | Ahn et al. |
| 2010/0182203 | A1 | 7/2010 | See |
| 2010/0238072 | A1 | 9/2010 | Ayatollahi |
| 2010/0253651 | A1 | 10/2010 | Day |
| 2011/0012793 | A1 | 1/2011 | Amm et al. |
| 2011/0012794 | A1 | 1/2011 | Schlub et al. |
| 2011/0045789 | A1 | 2/2011 | Sinton et al. |
| 2011/0050509 | A1 | 3/2011 | Ayala Vazquez et al. |
| 2011/0212746 | A1 | 9/2011 | Sarkar et al. |
| 2011/0241949 | A1 | 10/2011 | Nickel et al. |
| 2011/0260924 | A1 | 10/2011 | Roy |
| 2011/0260939 | A1 | 10/2011 | Korva et al. |
| 2011/0300907 | A1 | 12/2011 | Hill |
| 2012/0009983 | A1 | 1/2012 | Mow et al. |
| 2012/0068893 | A1 | 3/2012 | Guterman et al. |
| 2012/0092298 | A1 | 4/2012 | Koottungal |
| 2012/0112969 | A1 | 5/2012 | Caballero et al. |
| 2012/0112970 | A1 | 5/2012 | Caballero et al. |
| 2012/0176279 | A1 | 7/2012 | Merz et al. |
| 2012/0214412 | A1 | 8/2012 | Schlub et al. |
| 2012/0223865 | A1 | 9/2012 | Li et al. |
| 2012/0223866 | A1 | 9/2012 | Ayala Vazquez et al. |
| 2012/0229360 | A1 | 9/2012 | Jagielski et al. |
| 2012/0299785 | A1 | 11/2012 | Bevelacqua |
| 2013/0050038 | A1 | 2/2013 | Eom et al. |
| 2013/0082884 | A1 | 4/2013 | Gummalla |
| 2013/0106660 | A1 | 5/2013 | Kang |
| 2013/0115884 | A1 | 5/2013 | Zhang |
| 2013/0154900 | A1 | 6/2013 | Tsai |
| 2013/0169490 | A1 | 7/2013 | Pascolini et al. |
| 2013/0201067 | A1 | 8/2013 | Hu et al. |
| 2013/0203364 | A1 | 8/2013 | Darnell et al. |
| 2013/0234910 | A1 | 9/2013 | Oh et al. |
| 2013/0241800 | A1* | 9/2013 | Schlub ..... H01Q 1/243 343/893 |
| 2013/0257659 | A1 | 10/2013 | Darnell et al. |
| 2013/0285857 | A1 | 10/2013 | Schultz |
| 2013/0293425 | A1 | 11/2013 | Zhu et al. |
| 2013/0321216 | A1 | 12/2013 | Jervis et al. |
| 2013/0328730 | A1 | 12/2013 | Guterman et al. |
| 2013/0333496 | A1 | 12/2013 | Boutouil et al. |
| 2013/0342411 | A1 | 12/2013 | Jung |
| 2014/0009352 | A1 | 1/2014 | Sung et al. |
| 2014/0292598 | A1 | 1/2014 | Bevelacqua et al. |
| 2014/0057578 | A1 | 2/2014 | Chan et al. |
| 2014/0086441 | A1 | 3/2014 | Zhu et al. |
| 2014/0184450 | A1 | 7/2014 | Koo |
| 2014/0253392 | A1 | 9/2014 | Yarga et al. |
| 2014/0266922 | A1 | 9/2014 | Jin et al. |
| 2014/0266923 | A1 | 9/2014 | Zhou et al. |
| 2014/0266938 | A1 | 9/2014 | Ouyang et al. |
| 2014/0266941 | A1 | 9/2014 | Ayala Vazquez et al. |
| 2014/0292587 | A1 | 10/2014 | Yarga et al. |
| 2014/0306857 | A1 | 10/2014 | Bevelacqua et al. |
| 2014/0306859 | A1 | 10/2014 | Desclos et al. |
| 2014/0313087 | A1 | 10/2014 | Jiang et al. |
| 2014/0313099 | A1 | 10/2014 | Pajona et al. |
| 2014/0315592 | A1 | 10/2014 | Schlub et al. |
| 2014/0328488 | A1 | 11/2014 | Caballero et al. |
| 2014/0333495 | A1 | 11/2014 | Ayala Vazquez et al. |
| 2014/0333496 | A1 | 11/2014 | Hu et al. |
| 2014/0340265 | A1 | 11/2014 | Ayala Vazquez et al. |
| 2014/0375509 | A1 | 12/2014 | Vance et al. |
| 2015/0180123 | A1 | 6/2015 | Tatomirescu |
| 2015/0236426 | A1 | 8/2015 | Zhu et al. |
| 2015/0255851 | A1 | 9/2015 | Guterman et al. |
| 2015/0257158 | A1 | 9/2015 | Jadhav et al. |
| 2015/0270618 | A1 | 9/2015 | Zhu et al. |
| 2015/0270619 | A1 | 9/2015 | Zhu et al. |
| 2015/0311594 | A1 | 10/2015 | Zhu et al. |

FOREIGN PATENT DOCUMENTS

| | | |
|---|---|---|
| CN | 101330162 | 12/2008 |
| DE | 102005035935 | 2/2007 |
| EP | 0086135 | 8/1983 |
| EP | 0 564 164 | 10/1993 |
| EP | 1298809 | 4/2003 |
| EP | 1324425 | 7/2003 |
| EP | 1361623 | 11/2003 |
| EP | 1 469 550 | 10/2004 |
| EP | 1 524 774 | 4/2005 |
| EP | 1564896 | 8/2005 |
| EP | 1593988 | 11/2005 |
| GB | 2 380 359 | 4/2003 |
| JP | 05-128828 | 5/1993 |
| JP | 2003179670 | 6/2003 |
| JP | 2003209483 | 7/2003 |
| JP | 2003330618 | 11/2003 |
| JP | 2004005516 | 1/2004 |
| JP | 200667061 | 3/2006 |
| JP | 2007-170995 | 7/2007 |
| JP | 2008046070 | 2/2008 |
| JP | 2009032570 | 2/2009 |
| WO | 0131733 | 5/2001 |
| WO | 02/05443 | 1/2002 |
| WO | 2004010528 | 1/2004 |
| WO | 2004112187 | 12/2004 |
| WO | 2005112280 | 11/2005 |
| WO | 2007116790 | 4/2006 |
| WO | 2006060232 | 6/2006 |
| WO | 2007124333 | 1/2007 |
| WO | 2008/078142 | 7/2008 |
| WO | 2009022387 | 2/2009 |
| WO | 2009149023 | 12/2009 |
| WO | 2011022067 | 2/2011 |
| WO | 2013123109 | 8/2013 |
| WO | 2013165419 | 11/2013 |
| WO | 2015142476 | 9/2015 |

OTHER PUBLICATIONS

"CapTouch Programmable Controller for Single-Electrode Capacitance Sensors", AD7147 Data Sheet Rev. B, [online], Analog Devices, Inc., [retrieved on Dec. 7, 2009], <URL: http://www.analog.com/static/imported-files/data_sheets/AD7147.pdf>.

(56) References Cited

OTHER PUBLICATIONS

Liu et al., "MEMS-Switched Frequency-Tunable Hybrit Slot/PIFA Antenna", IEEE Antennas and Wireless Propagation Letters, vol. 8, 2009, p. 311-314.
The ARRL Antenna Book, Published by the American Radio League, 1998, 15th Edition, ISBN: 1-87259-206-5.
Pance et al., U.S. Appl. No. 61/235,905, filed Aug. 21, 2009.
Pascolini et al., U.S. Appl. No. 14/710,377, filed May 12, 2015.
Azad et al., U.S. Appl. No. 15/066,419, filed May 10, 2016.

* cited by examiner

| TUNING/SWITCH MODE | PARASITIC SWITCH STATE | RESONATING ELEMENT SWITCH STATE | LB PERFORMANCE | MB PERFORMANCE | HB PERFORMANCE |
|---|---|---|---|---|---|
| M1 | OPEN | ALL OPEN | HIGH | NONE | NONE |
| M2 | CLOSED | ALL OPEN | HIGH | HIGH | NONE |
| M3 | OPEN | AT LEAST ONE CLOSED | LOW | HIGH | HIGH |

*FIG. 9*

HYBRID ELECTRONIC DEVICE ANTENNAS HAVING PARASITIC RESONATING ELEMENTS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device may have a metal housing that forms a ground plane. The ground plane may, for example, be formed from a rear housing wall and sidewalls. The ground plane and other structures in the electronic device may be used in forming antennas.

The electronic device may include one or more hybrid antennas. The hybrid antennas may each include a slot antenna resonating element formed from a slot in the ground plane and a planar antenna resonating element formed from a planar metal member disposed over the slot. The planar antenna resonating element may be coupled to a positive antenna feed terminal. The planar antenna resonating element may be directly fed and may serve as an indirect feed structure for the slot antenna resonating element.

A parasitic antenna resonating element may be disposed over the planar antenna resonating element. The parasitic antenna resonating element may be configured to constructively interfere with the electromagnetic field generated by the planar antenna resonating element. A switch may be coupled between the parasitic antenna resonating element and the ground plane. A tunable circuit such as an adjustable inductor may be coupled between the planar antenna resonating element and the ground plane.

The electronic device may include control circuitry. The control circuitry may control the switch and the tunable circuit to place the hybrid antenna in at least one of three different tuning states (settings) or modes. In the first tuning state, the tunable circuit may form an open circuit between the planar antenna resonating element and the ground plane and the switch may be opened to form an open circuit between the parasitic antenna resonating element and the ground plane. In the second tuning state, the tunable circuit may form an open circuit between the planar antenna resonating element and the ground plane and the switch may be closed to form a short circuit path between the parasitic antenna resonating element and the ground plane. In the third tuning state, the tunable circuit may form a closed return path between the planar metal element and the antenna ground and the switch may form an open circuit between the parasitic antenna resonating element and the antenna ground.

When controlled to operate in the first tuning state, the slot antenna resonating element may resonate at a first frequency in a low band (e.g., 700-960 MHz). When controlled to operate in the second tuning state, the slot antenna resonating element may resonate at the first frequency while the parasitic antenna resonating element, the antenna ground, and the planar antenna resonating element resonate at a second frequency in a midband (e.g., 1400-1900 MHz). When controlled to operate in the third tuning state, the slot antenna resonating element may resonate at the first frequency and at a third (harmonic) frequency in a high band (e.g., 1900-2700 MHz) while the planar antenna resonating element and the antenna ground resonate in the midband. Adjustable capacitor circuitry that bridges the slot may be controlled to tune the first frequency if desired. This may allow the antenna to operate with satisfactory antenna efficiency in the low band, midband, and high band (e.g., to allow the antenna to perform concurrent communications in cellular telephone and satellite navigation communications bands) despite volume constraints imposed on the antenna.

BRIEF DESCRIPTION OF THE DRAWINGS

FIG. 9 is a chart showing how antennas of the type shown in FIGS. 6-8 may be used in covering different communications bands of interest by adjusting associated tuning circuitry in accordance with an embodiment.

DETAILED DESCRIPTION

Figure 1:
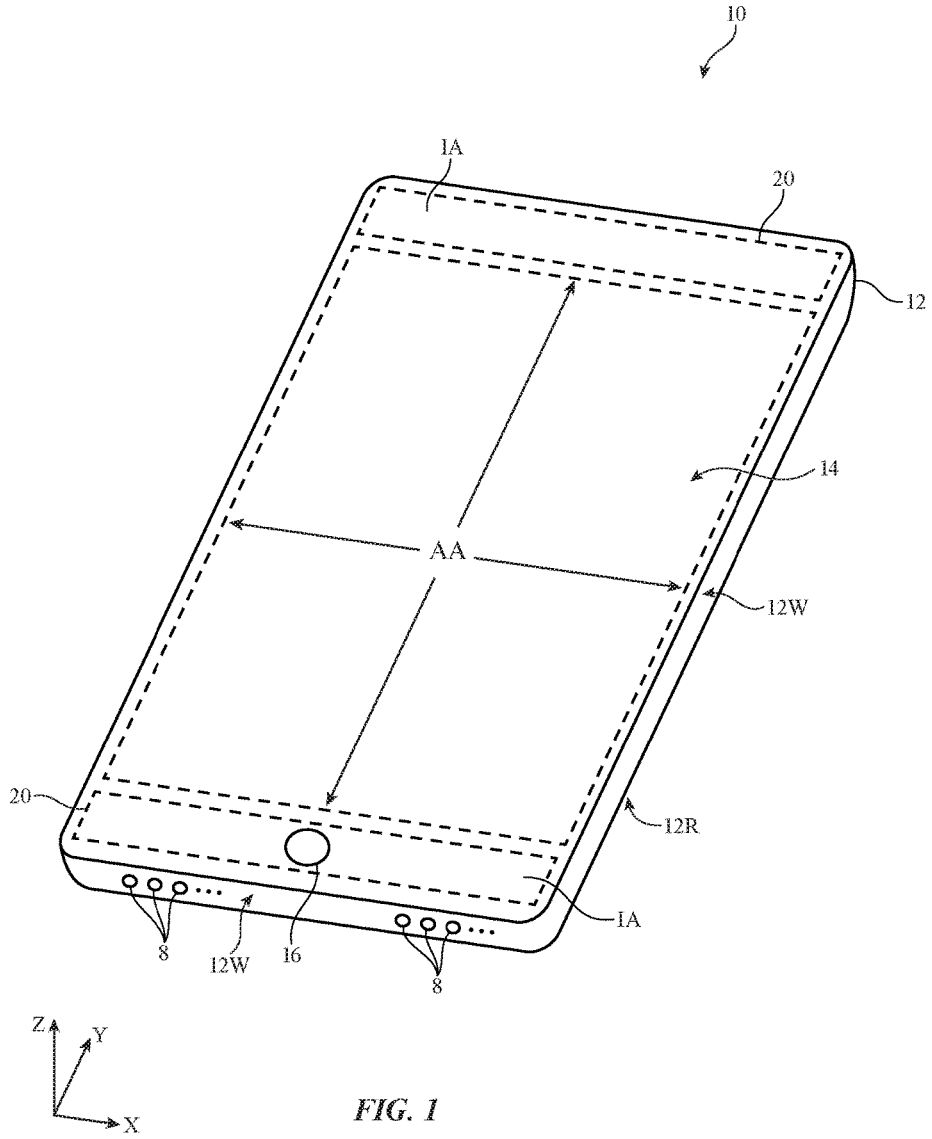
FIG. 1 is a front perspective view of an illustrative electronic device in accordance with an embodiment.

An electronic device such as electronic device 10 of FIG. 1 may be provided with wireless circuitry that includes antenna structures. The antenna structures may include hybrid antennas. The hybrid antennas may be hybrid planar-inverted-F-slot antennas that include slot antenna resonating elements and planar inverted-F antenna resonating elements. The planar inverted-F antenna resonating elements may indirectly feed the slot antenna resonating elements and may contribute to the frequency responses of the antennas. Slots for the slot antenna resonating elements may be formed in ground structures such as conductive housing structures and may be filled with a dielectric such as plastic. The hybrid antennas may be provided with switchable parasitic antenna resonating elements that are not directly fed. The parasitic antenna resonating elements may optimize the efficiency of the antenna in certain communications bands, for example.

The wireless circuitry of device 10 may handle one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14. Display 14 may be mounted in a housing such as housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). In the example of FIG. 1, housing 12 includes a conductive peripheral sidewall structure 12W that surrounds a periphery of device 10 (e.g., that surrounds the rectangular periphery of device 10 as shown in FIG. 1). Housing 12 may, if desired, include a conductive rear wall structure 12R that opposes display 14 (e.g., conductive rear wall structure 12R may form the rear exterior face, side, or surface of device 10). If desired, rear wall 12R and sidewalls 12W may be formed from a continuous metal structure (e.g., in a unibody configuration) or from separate metal structures. Openings may be formed in housing 12 to form communications ports, holes for buttons, and other structures if desired.

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may have an active area AA that includes an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10 (e.g., extending across an entirety of a length dimension of device 10 parallel to the y-axis and a width dimension of device 10 parallel to the x-axis of FIG. 1). In another suitable arrangement, the display cover layer may cover substantially all of the front face of device 10 or only a portion of the front face of device 10. Openings may be formed in the display cover layer. For example, an opening may be formed in the display cover layer to accommodate a button such as button 16. An opening may also be formed in the display cover layer to accommodate ports such as a speaker port. Openings such as openings 8 may be formed in housing 12 to form communications ports (e.g., an audio jack port, a digital data port, etc.) and/or audio ports for audio components such as a speaker and/or a microphone.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layer in display 14 that overlaps inactive area IA may be coated with an opaque masking layer in inactive area IA. The opaque masking layer may have any suitable color.

Antennas may be mounted in housing 12. For example, housing 12 may have four peripheral edges (e.g., conductive sidewalls 12W) as shown in FIG. 1 and one or more antennas may be located along one or more of these edges. As shown in the illustrative configuration of FIG. 1, antennas may, if desired, be mounted in regions 20 along opposing peripheral edges of housing 12 (as an example). The antennas may include antenna resonating elements that emit and receive signals through the front of device 10 (i.e., through inactive portions IA of display 14) and/or from the rear and sides of device 10. In practice, active components within active display area AA may block or otherwise inhibit signal reception and transmission by the antennas. By placing the antennas within regions 20 of inactive area IA of display 14, the antennas may freely pass signals through the display without the signals being blocked by active display circuitry. Antennas may also be mounted in other portions of device 10, if desired. The configuration of FIG. 1 is merely illustrative.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the space 20 that is available for forming antennas within device 10. In general, antennas that are provided with larger operating volumes or spaces may have wider bandwidth efficiency than antennas that are provided with smaller operating volumes or spaces. If care is not taken, increasing the size of active area AA may reduce the operating space available to the antennas, which can undesirably inhibit the efficiency and bandwidth of the antennas (e.g., such that the antennas no longer exhibit satisfactory radio-frequency performance). Such inhibition of efficiency and bandwidth can become particularly pronounced at lower frequencies such as cellular telephone frequencies between 700 and 960 MHz. It would therefore be desirable to be able to provide antennas that occupy a small amount of space within device 10 (e.g., to allow for as large of a display active area AA as possible) while still allowing the antennas to operate with optimal efficiency and bandwidth at all frequencies of interest.

Figure 2:
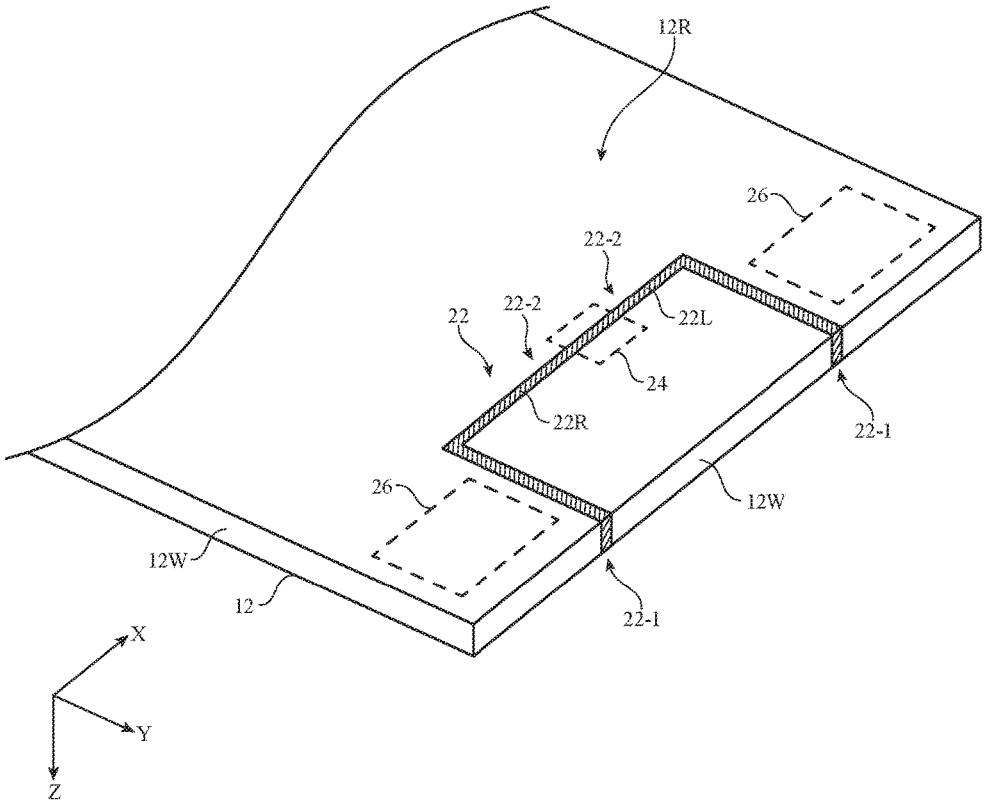
FIG. 2 is a rear perspective view of a portion of the illustrative electronic device of FIG. 1 in accordance with an embodiment.

FIG. 2 is a rear perspective view of the upper end of housing 12 and device 10 of FIG. 1. As shown in FIG. 2, one or more slots such as slot 22 may be formed in housing 12. Housing 12 may be formed from a conductive material such as metal. Slot 22 may be an elongated opening in the metal of housing 12 and may be filled with a dielectric material such as glass, ceramic, plastic, or other insulator (i.e., slot 22 may be a dielectric-filled slot). The width of slot 22 may be 0.1-1 mm, less than 1.3 mm, less than 1.1 mm, less than 0.9 mm, less than 0.7 mm, less than 0.5 mm, less than 0.3 mm, more than 0.2 mm, more than 0.5 mm, more than 0.1 mm, 0.2-0.9 mm, 0.2-0.7 mm, 0.3-0.7 mm, or other suitable width. The length of slot 22 may be more than 4 cm, more than 6 cm, more than 10 cm, 5-20 cm, 4-15 cm, less than 15 cm, less than 25 cm, or other suitable length.

Slot 22 may extend across rear housing wall 12R and, if desired, an associated sidewall such as sidewall 12W. Rear housing wall 12R may be planar or may be curved. Sidewall 12W may be an integral portion of rear wall 12R or may be a separate structure. Housing wall 12R (and, if desired, sidewalls such as sidewall 12W) may be formed from aluminum, stainless steel, or other metals and may form a ground plane for device 10. Slots in the ground plane such as slot 22 may be used in forming antenna resonating elements.

In the example of FIG. 2, slot 22 has a U-shaped footprint (i.e., the outline of slot 22 has a U shape when viewed along dimension Z). Other shapes for slot 22 may be used, if desired (e.g., straight shapes, shapes with curves, meandering shapes, circular shapes, shapes with curved and straight segments, etc.). Slot 22 may be partially formed within one sidewall 12W or within two or more sidewalls 12W. With a layout of the type shown in FIG. 2, the bends in slot 22 create space along the left and right edges of housing 12 for components 26. Components 26 may be, for example, speakers, microphones, cameras, sensors, or other electrical components.

Slot 22 may be divided into two shorter slots using a conductive member such as conductive structure 24 or a set of one or more switches that can be controlled by a control circuit. Conductive structure 24 may be formed from metal traces on a printed circuit, metal foil, metal portions of a housing bracket, wire, a sheet metal structure, or other conductive structure in device 10. Conductive structure 24 may be shorted to metal housing wall 12R on opposing sides of slot 22. If desired, conductive structures such as conductive structure 24 may be formed from integral portions of metal housing 12 (e.g., slot 22 may be discontinuous and housing 12 may be continuous at the location element 24) and/or adjustable circuitry that bridges slot 22.

In the presence of conductive structure 24 (or when switches in structure 24 are closed), slot 22 may be divided into first and second slots 22L and 22R. Ends 22-1 of slots 22L and 22R are surrounded by air and dielectric structures such as glass or other dielectric associated with a display cover layer for display 14 and are therefore sometimes referred to as open slot ends. Ends 22-2 of slots 22L and 22R are terminated in conductive structure 24 and therefore are sometimes referred to as closed slot ends. In the example of FIG. 2, slot 22L is an open slot having an open end 22-1 and an opposing closed end 22-2. Slot 22R is likewise an open slot. If desired, device 10 may include closed slots (e.g., slots in which both ends are terminated with conductive structures). The configuration of FIG. 2 is merely illustrative. Slot 22 and the other structures of FIG. 2 may be formed on the lower side of device 10 (e.g., the side of device 10 adjacent to button 16) or elsewhere on device 10 if desired. If desired, only one of slots 22L and 22R may be formed at any location along housing 12.

Slot 22 may be fed using an indirect feeding arrangement. With indirect feeding, a structure such as a planar antenna resonating element may be near-field coupled to slot 22 and may serve as an indirect feed structure. The planar antenna resonating element may also exhibit resonances that contribute to the frequency response of the antenna formed from slot 22 (e.g., the antenna may be a hybrid planar-inverted-F-slot antenna).

Figure 3:
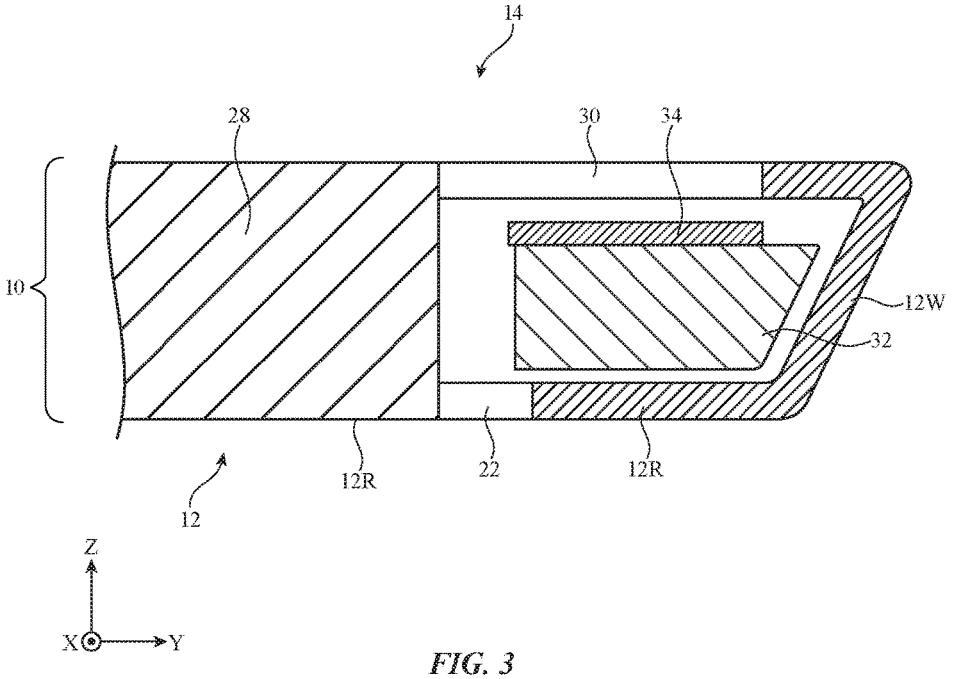
FIG. 3 is a cross-sectional side view of a portion of an illustrative electronic device in accordance with an embodiment.

A cross-sectional side view of device 10 in the vicinity of slot 22 is shown in FIG. 3. In the example of FIG. 3, conductive structures 28 may include display 14, conductive housing structures such as metal rear housing wall 12R, etc. Dielectric layer 30 may be a portion of a glass layer (e.g., a portion of a display cover layer for protecting display 14). The underside of layer 30 may, if desired, be covered with an opaque masking layer to block internal components in device 10 from view. Dielectric support 32 may be used to support conductive structures such as metal structure 34. Metal structure 34 may be located under dielectric layer 30 and may, if desired, be used in forming an antenna feed structure (e.g., structure 34 may be a planar metal member that forms part of a planar inverted-F antenna resonating element structure or patch antenna resonating element structure that is near-field coupled to slot 22 in housing 12). During operation, antenna signals associated with an antenna formed from slot 22 and/or metal structure 34 may be transmitted and received through the front of device 10 (e.g., through dielectric layer 30) and/or the rear of device 10.

Figure 4:
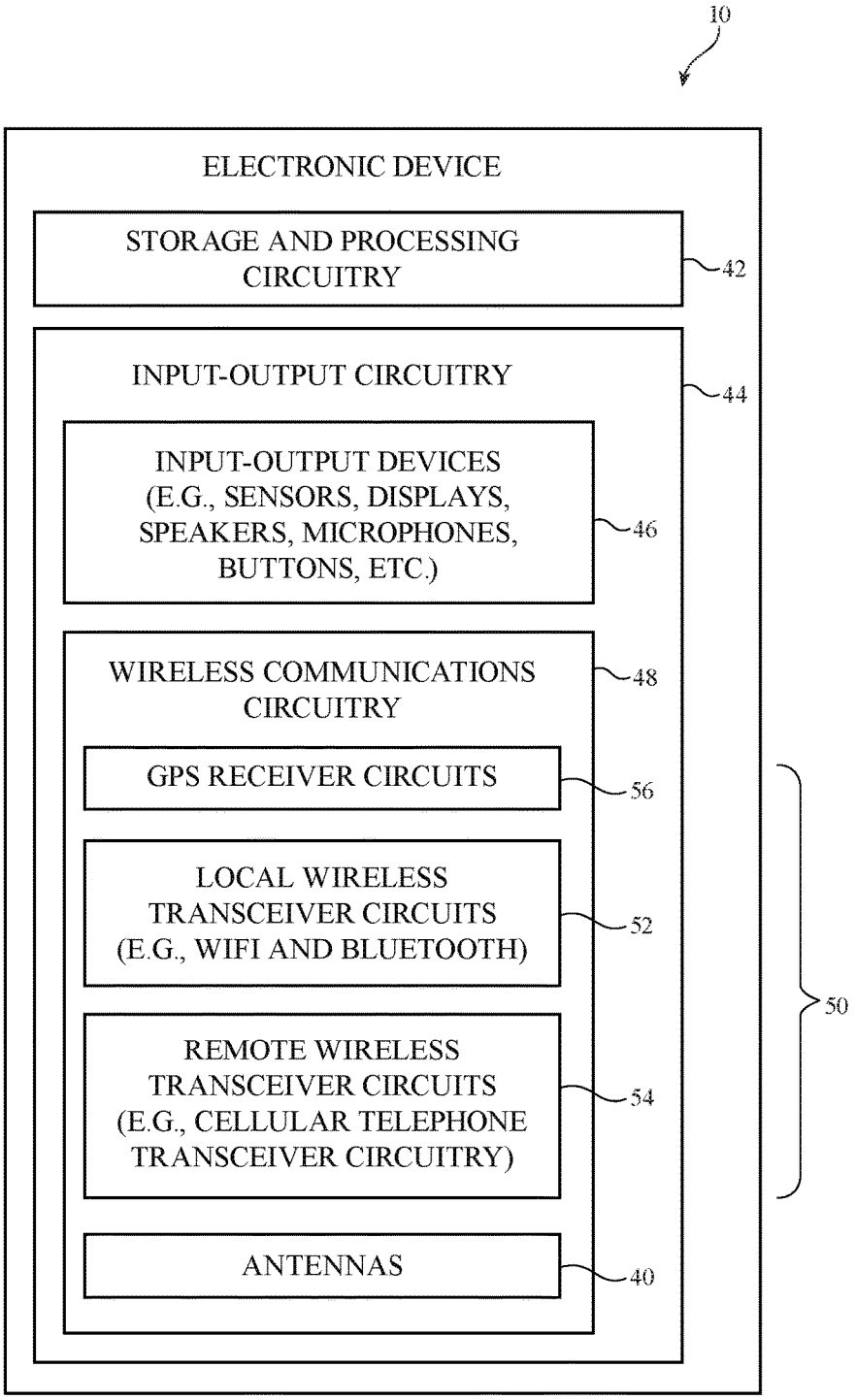
FIG. 4 is a schematic diagram of illustrative circuitry in an electronic device in accordance with an embodiment.

A schematic diagram showing illustrative components that may be used in device 10 is shown in FIG. 4. As shown in FIG. 4, device 10 may include control circuitry such as storage and processing circuitry 42. Storage and processing circuitry 42 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 42 may be used to control the operation of device 10. This processing circuitry may be based on one or more microprocessors, microcontrollers, digital signal processors, application specific integrated circuits, etc.

Storage and processing circuitry 42 may be used to run software on device 10, such as internet browsing applications, voice-over-internet-protocol (VOIP) telephone call applications, email applications, media playback applications, operating system functions, etc. To support interactions with external equipment, storage and processing circuitry 42 may be used in implementing communications protocols. Communications protocols that may be implemented using storage and processing circuitry 42 include internet protocols, wireless local area network protocols (e.g., IEEE 802.11 protocols—sometimes referred to as WiFi®), protocols for other short-range wireless communications links such as the Bluetooth® protocol, cellular telephone protocols, MIMO protocols, antenna diversity protocols, etc.

Input-output circuitry 44 may include input-output devices 46. Input-output devices 46 may be used to allow data to be supplied to device 10 and to allow data to be provided from device 10 to external devices. Input-output devices 46 may include user interface devices, data port devices, and other input-output components. For example, input-output devices 46 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, etc.

Input-output circuitry 44 may include wireless communications circuitry 48 for communicating wirelessly with external equipment. Wireless communications circuitry 48 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 48 may include radio-frequency transceiver circuitry 50 for handling various radio-frequency communications bands. For example, circuitry 48 may include transceiver circuitry 52, 54, and 56. Transceiver circuitry 52 may be wireless local area network transceiver circuitry that may handle 2.4 GHz and 5 GHz bands for WiFi® (IEEE 802.11) communications and that may handle the 2.4 GHz Bluetooth® communications band. Circuitry 48 may use cellular telephone transceiver circuitry 54 for handling wireless communications in frequency ranges such as a low communications band "LB" from 700 to 960 MHz, a midband "MB" from 1400 MHz or 1500 MHz to 2170 MHz (e.g., a midband with a peak at 1700 MHz), and a high band "HB" from 2170 or 2300 to 2700 MHz (e.g., a high band with a peak at 2400 MHz) or other communications bands between 700 MHz and 2700 MHz or other suitable frequencies (as examples). Circuitry 54 may handle voice data and non-voice data. Wireless communications circuitry 48 can include circuitry for other short-range and long-range wireless links if desired. For example, wireless communications circuitry 48 may include 60 GHz transceiver circuitry, circuitry for receiving television and radio signals, paging system transceivers, near field communications (NFC) circuitry, etc. Wireless communications circuitry 48 may include satellite navigation system circuitry such as global positioning system (GPS) receiver circuitry 56 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 48 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, monopole antenna structures, dipole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 5:
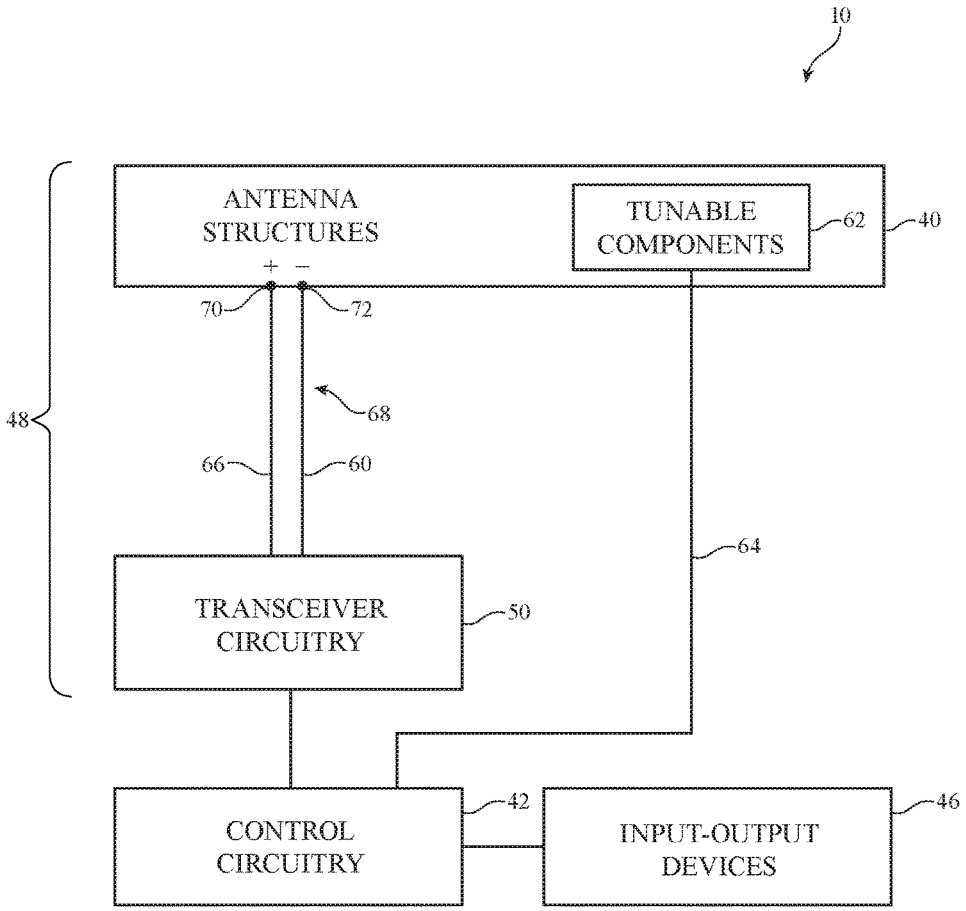
FIG. 5 is a diagram of illustrative wireless circuitry in an electronic device in accordance with an embodiment.

As shown in FIG. 5, transceiver circuitry 50 in wireless circuitry 48 may be coupled to antenna structures 40 using paths such as path 60. Wireless circuitry 48 may be coupled to control circuitry 42. Control circuitry 42 may be coupled to input-output devices 46. Input-output devices 46 may supply output from device 10 and may receive input from sources that are external to device 10.

To provide antenna structures 40 with the ability to cover communications frequencies of interest, antenna structures 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna structures 40 may be provided with adjustable circuits such as tunable components 62 to tune antennas over communications bands of interest. Tunable components 62 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures.

During operation of device 10, control circuitry 42 may issue control signals on one or more paths such as path 64 that adjust inductance values, capacitance values, or other parameters associated with tunable components 62, thereby tuning antenna structures 40 to cover desired communications bands.

Path 60 may include one or more transmission lines. As an example, signal path 60 of FIG. 5 may be a transmission line having first and second conductive paths such as paths 66 and 68, respectively. Path 66 may be a positive signal line and path 68 may be a ground signal line. Lines 66 and 68 may form parts of a coaxial cable, a stripline transmission line, and/or a microstrip transmission line (as examples). A matching network formed from components such as inductors, resistors, and capacitors may be used in matching the impedance of antenna structures 40 to the impedance of transmission line 60. Matching network components may be provided as discrete components (e.g., surface mount technology components) or may be formed from housing structures, printed circuit board structures, traces on plastic supports, etc. Components such as these may also be used in forming filter circuitry in antenna structures 40.

Transmission line 60 may be directly coupled to an antenna resonating element and ground for antenna 40 or may be coupled to near-field-coupled antenna feed structures that are used in indirectly feeding a resonating element for antenna 40. As an example, antenna structures 40 may form an inverted-F antenna, a slot antenna, a hybrid inverted-F slot antenna or other antenna having an antenna feed with a positive antenna feed terminal such as terminal 70 and a ground antenna feed terminal such as ground antenna feed terminal 72. Positive transmission line conductor 66 may be coupled to positive antenna feed terminal 70 and ground transmission line conductor 68 may be coupled to ground antenna feed terminal 72. Antenna structures 40 may include an antenna resonating element such as a slot antenna resonating element or other element that is indirectly fed using near-field coupling. In a near-field coupling arrangement, transmission line 60 is coupled to a near-field-coupled antenna feed structure that is used to indirectly feed antenna structures such as an antenna slot or other element through near-field electromagnetic coupling.

Figure 6:
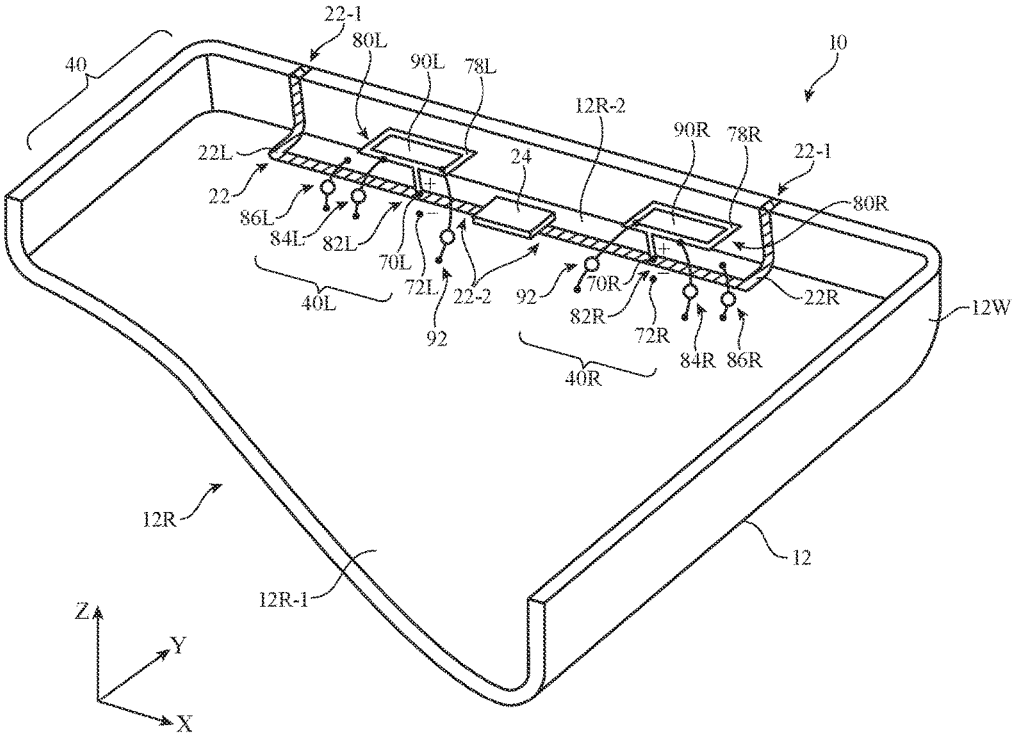
FIG. 6 is a perspective interior view of an illustrative electronic device with a metal housing having a dielectric-filled slot for hybrid antennas having parasitic antenna resonating elements in accordance with an embodiment.

Antennas 40 may include hybrid antennas formed both from planar antenna structures (e.g., planar inverted-F antenna structures) and slot antenna structures. An illustrative configuration in which device 10 has two hybrid antennas formed from the left and right portions of slot 22 in housing 12 is shown in FIG. 6. FIG. 6 is an interior perspective view of device 10 at the upper end of housing 12.

As shown in FIG. 6, slot 22 may be divided into left slot 22L and right slot 22R by conductive structures 24 (e.g., an integral and continuous portion of rear housing wall 12R) that bridge the center of slot 22. Rear housing wall 12R (e.g., a metal housing wall in housing 12 that opposes the face of device 10 at which display 14 is formed) may have a first portion such as portion 12R-1 and a second portion such as portion 12R-2 that is separated from portion 12R-1 by slot 22. Conductive structures 24 may be shorted to rear housing wall portion 12R-1 on one side of slot 22 and may be shorted to rear housing wall portion 12R-2 on the other side of slot 22 (or may extend continuously from portion 12R-1 to portion 12R-2 on both sides of slot 22 when structures 24 are an integral portion of housing 12R). The presence of the short circuit formed by structures 24 across slot 22 creates closed ends 22-2 for left slot 22L and right slot 22R.

Antennas 40 of FIG. 6 include left antenna 40L and right antenna 40R. Device 10 may switch between antennas 40L and 40R in real time to ensure that signal strength is maximized, may use antennas 40L and 40R simultaneously, or may otherwise use antennas 40L and 40R to enhance wireless performance for device 10 (e.g., using antenna diversity or multiple-input multiple-output (MIMO) schemes).

Left antenna 40L and right antenna 40R may be hybrid antennas each of which has a planar antenna resonating element (e.g., a planar patch or planar inverted-F antenna resonating element) and a slot antenna resonating element.

The slot antenna resonating element of antenna 40L may be formed by slot 22L. Planar antenna resonating element 80L (e.g., planar inverted-F antenna or planar patch antenna resonating element 80L) serves as an indirect feeding structure for antenna 40L and is near-field coupled to the slot resonating element formed from slot 22L. During operation, slot 22L and element 80L may each contribute to the overall frequency response of antenna 40L. As shown in FIG. 6, antenna 40L may have an antenna feed such as feed 82L. Feed 82L is coupled between planar antenna resonating element 80L and ground (i.e., metal housing 12R-1). A radio-frequency transmission line (see, e.g., transmission line 60 of FIG. 5) may be coupled between transceiver circuitry 50 and antenna feed 82L. Feed 82L has positive antenna feed terminal 70L and ground antenna feed terminal 72L. Ground antenna feed terminal 72L may be shorted to ground (e.g., metal wall 12R-1). Positive antenna feed terminal 70L may be coupled to planar metal element 78L via a leg, arm, branch, or other conductive path that extends downwards from planar resonating element 80L towards the ground formed from metal wall 12R-1. Planar antenna resonating element 80L may also have a return path such as return path 84L that is coupled between planar element 78L and antenna ground (metal housing 12R-1) in parallel with feed 82L.

The slot antenna resonating element of antenna 40R is formed by slot 22R. Planar antenna resonating element 80R (e.g., a planar inverted-F antenna resonating element or planar patch antenna resonating element) serves as an indirect feeding structure for antenna 40R and is near-field coupled to the slot resonating element formed from slot 22R. Slot 22R and element 80R both contribute to the overall frequency response of hybrid planar-inverted-F-slot antenna 40R. Antenna 40R may have an antenna feed such as feed 82R. Feed 82R is coupled between planar antenna resonating element 80R and ground (metal housing 12R-1). A transmission line such as transmission line 60 may be coupled between transceiver circuitry 50 and antenna feed 82R. Feed 82R may have positive antenna feed terminal 70R and ground antenna feed terminal 72R. Ground antenna feed terminal 72R may be shorted to ground (e.g., metal wall 12R-1). Positive antenna feed terminal 70R may be coupled to planar metal structure 78R of planar resonating element 80R. Planar resonating element 80R may have a return path such as return path 84R that is coupled between planar element 78R and antenna ground (metal housing 12R-1).

Return paths 84L and 84R may be formed from strips of metal without any tunable components or may include tunable inductors or other adjustable circuits for tuning antennas 40. Additional tunable components may also be incorporated into antennas 40, if desired. For example, tunable (adjustable) components 86L may bridge slot 22L in antenna 40L and tunable (adjustable) components 86R may bridge slot 22R in antenna 40R.

In the example of FIG. 6, tunable components 86L are interposed between feed 82L and open slot end 22-1 of left slot 22L and tunable components 86R are interposed between feed 82R and open slot end 22-1 of right slot 22R. This is merely illustrative. If desired, components 86L may be interposed between feed 82L and closed end 22-2 of slot 22L and/or components 86R may be interposed between feed 82R and closed end 22-2 of slot 22L. Components 86L may bridge slot 22L on both sides of feed 82L and/or components 86R may bridge slot 22R on both sides of feed 82R. If desired, components 86L and/or 86R may be omitted.

Antennas 40 may support any suitable frequencies of operation. As an example, antennas 40 may operate in a low band LB, midband MB, and high band HB. Slots 22L and 22R may have lengths (quarter wavelength lengths) that support resonances in the low communications band LB (e.g., a low band at frequencies between 700 and 960 MHz). Midband coverage (e.g., for a midband MB from 1400 or 1500 MHz to 1.9 GHz or other suitable midband range) may be provided by the resonance exhibited by planar antenna resonating elements 80L and 80R. High band coverage (e.g., for a high band centered at 2400 MHz and extending to 2700 MHz or another suitable frequency) may be supported using harmonics of the slot antenna resonating element resonance (e.g., a third order harmonic, etc.).

In order to provide as large an active area AA for display 14 as possible (e.g., to maximize an area of the device used for displaying media, running applications, etc.) it may be desirable to increase the amount of area at the front face of device 10 that is covered by active area AA of display 14. Increasing the size of active area AA may reduce the size of inactive area IA within device 10 (see, e.g., FIG. 1). This reduces the amount of space available for forming antennas 40 within device 10.

In general, antennas that are provided with larger operating volumes or spaces may have higher efficiency and bandwidth than antennas that are provided with smaller operating volumes or spaces. Increasing the size of active area AA may reduce the operating space available to the antennas and may undesirably inhibit the efficiency and bandwidth of the antennas (e.g., such that the antennas no longer exhibit satisfactory radio-frequency performance). This inhibition of efficiency and bandwidth may be particularly pronounced at lower frequencies (higher wavelengths) such as within low band LB (e.g., at frequencies between 700 and 960 MHz). Tuning circuitry such as tuning circuits 86 and 84 may be adjusted to help provide satisfactory efficiency and bandwidth within the low band LB. However, if care is not taken, it can be difficult for antennas 40 to exhibit satisfactory antenna performance (e.g., efficiency and bandwidth) in each of low band LB, mid band MB, and high band HB as the size of area IA is reduced (e.g., as the size of area IA is reduced so that the distance between active area AA and housing sidewall 12W is 5 mm, less than 5 mm, 9 mm, less than 9 mm, between 9 and 15 mm, or another distance).

In order to enhance antenna efficiency and bandwidth as the size of area IA is reduced, antennas 40 may each be provided with a corresponding parasitic antenna resonating element 90 (sometimes referred to herein as parasitic resonating element 90, parasitic antenna element 90, parasitic element 90, parasitic patch 90, parasitic conductor 90, parasitic structure 90, or parasitic 90). For example, antenna 40L may be provided with a corresponding parasitic antenna element 90L and antenna 40R may be provided with a corresponding parasitic antenna element 90R. Parasitic element 90L may be formed from a planar metal structure placed above (e.g., separated from) planar metal structure 78L of planar antenna resonating element 80L. Parasitic element 90R may be formed from a planar metal structure placed above planar metal structure 78R of planar antenna resonating element 80R. Parasitic elements 90 may create a constructive perturbation of the electromagnetic field generated by antenna resonating elements 80, creating a new resonance in a desired frequency band such as midband MB. Parasitic elements 90 are not directly fed, whereas resonating elements 80 are directly fed over feed terminals 70 and 72.

Parasitic elements 90 may be coupled to ground (e.g., housing 12R-1) by a corresponding short (ground) path 92. For example, parasitic element 90L may be coupled to ground by short circuit path 92L whereas parasitic element 90R is coupled to ground by short circuit path 92R. Short circuit paths 92 may include switching circuitry for selectively coupling and decoupling parasitic elements 90 to ground. When switching circuitry on path 92 couples parasitic element 90 to ground, parasitic element 90 may constructively interfere with the electromagnetic field generated by the corresponding resonating element 80. When switching circuitry on path 92 decouples parasitic element 90 from ground, parasitic element 90 may become a floating element that has negligible effect on the electromagnetic field generated by antenna resonating elements 80 (e.g., the parasitic element may create no new resonances for the corresponding antenna 40).

Control circuitry 42 (FIG. 1) may actively adjust switching circuitry on tunable paths 86, 84, and 92 to ensure that antennas 40 provide satisfactory coverage (e.g., satisfactory efficiency and bandwidth) in low band LB, mid band MB, and/or high band HB during communications. For example, control circuitry 42 may adjust tunable components in paths 86 to adjust the performance of antenna 40 in low band LB (e.g., to tune the antenna to a desired frequency in the low band LB). Control circuitry 42 may adjust tunable components in paths 84 to adjust the performance of antenna 40 in mid band MB (e.g., to tune the antenna to a desired frequency in the mid band MB) or to decouple planar element 78 from ground 12R. Control circuitry 42 may adjust tunable components in paths 82 to enhance the resonance of antenna 40 in mid band MB while antenna 40 also covers frequencies in low band LB, for example.

Antennas 40L and 40R may cover identical sets of frequencies or may cover overlapping or mutually exclusive sets of frequencies. As an example, antenna 40R may serve as a primary antenna for device 10 and may cover frequencies of 700-960 MHz and 1700-2700 MHz, whereas antenna 40L may serve as a secondary antenna that covers frequencies of 700-960 MHz and 1575-2700 MHz (or 1500-2700 MHz or 1400-2700 MHz, etc.).

The presence of the body of a user (e.g., a user's hand) or other external objects in the vicinity of antennas 40 may change the operating environment and tuning of antennas 40. For example, the presence of an external object may shift the low band resonance of antennas 40 to lower frequencies. If desired, real time antenna tuning using the adjustable components of FIG. 6 and/or other adjustable components may be used to ensure that antennas 40 operate satisfactorily regardless of whether external objects adjacent to antennas 40 are loading antennas 40.

Figure 7:
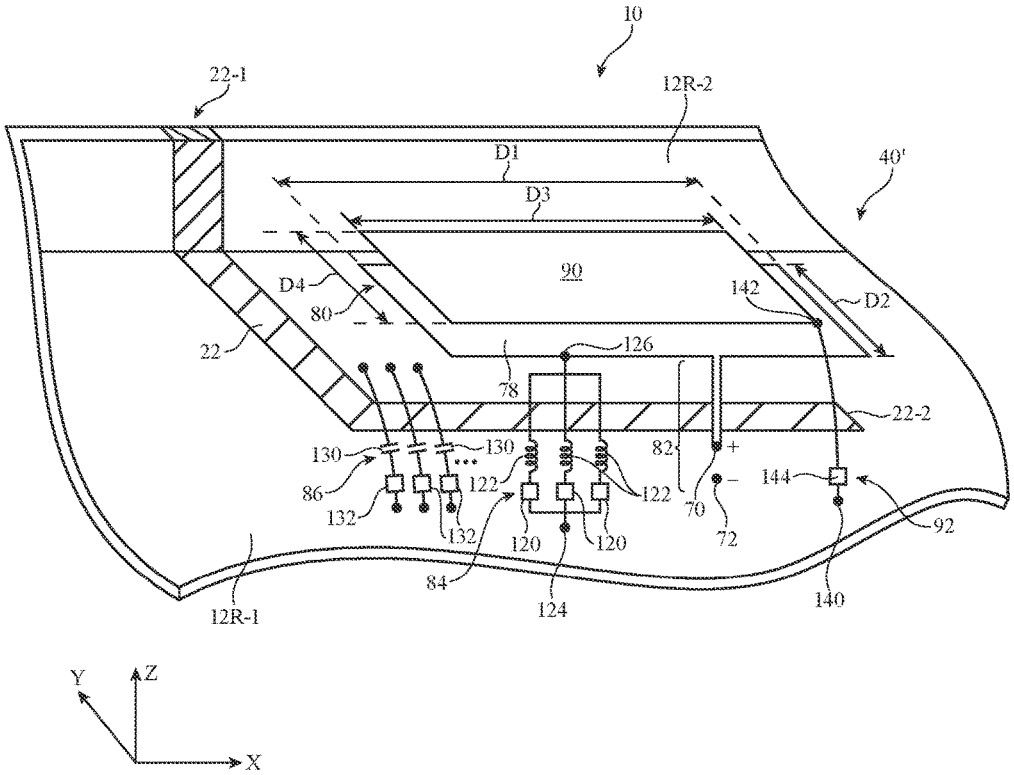
FIG. 7 is a perspective view of an illustrative hybrid antenna having a switchable parasitic antenna resonating element and a return path that includes an adjustable circuit in accordance with an embodiment.

FIG. 7 is a perspective view of an illustrative antenna configuration for device 10. Antenna 40' of FIG. 7 may be used in implementing an antenna such as antenna 40R and/or 40L of FIG. 6. In the arrangement of FIG. 7, planar antenna resonating element 80 is formed from planar metal structure 78. Structure 78 may overlap slot 22. Antenna 40' may be a hybrid antenna that includes a planar antenna (e.g., a planar inverted-F or patch antenna) formed from resonating element 80 and ground (e.g., metal housing 12R-1 and 12R-2) and that includes the slot antenna formed from slot 22.

Planar antenna 80 may serve as an indirect feed for the slot antenna formed from slot 22. Transmission line 82 may be coupled to terminals 70 and 72 of feed 82 for antenna 80. Return path 84 may be coupled between planar element 78 and the antenna ground formed from metal housing 12R-1 in parallel with feed 82. Return path 84 may include adjustable circuitry such as an adjustable inductor. The adjustable inductor may include switching circuitry such as switches 120 and respective inductors 122 coupled in parallel between terminal 124 on the ground formed from metal 12R-1 and terminal 126 on element 78. Control circuitry 42 may adjust adjustable circuits in device 10 such as adjustable return path 84 of FIG. 7 to tune antenna 40'. For example, switches 180 may be selectively opened and/or closed to switch desired inductors 122 into or out of use, thereby adjusting the inductance of the adjustable circuitry of return path 134. Adjusting the inductance of return path 134 may adjust the performance of antenna 40' at frequencies within the mid band MB, for example.

If desired, all of switches 120 may be open (e.g., in an "off" state or deactivated) to form an open circuit between metal structure 78 and ground 12R-1. When an open circuit is formed between structure 78 and ground 12R-1, planar resonating element 80 may operate as a patch antenna resonating element, for example. The patch antenna resonating element may contribute to the overall resonance of antenna 40' and/or may indirectly feed slot 22. When a conductive path is formed between structure 78 and ground 12R-1 (e.g., when one or more of switches 120 is closed), planar resonating element 80 may operate as a planar inverted-F antenna (e.g., where the return path of the planar inverted-F antenna is formed by path 84). The planar inverted-F antenna may contribute to the overall resonance of antenna 40' and/or may indirectly feed slot 22. Antenna 40' may therefore sometimes be referred to herein as a hybrid planar inverted-F slot antenna, a hybrid patch slot antenna, or simply as a hybrid antenna.

The example of FIG. 7 is merely illustrative. In general, any desired inductive and/or capacitive components may be coupled in path 84 between structure 78 and ground 12R-1 in any desired manner (e.g., in series and/or in parallel). Any desired number of switches 120 may be used. For example, a single switch or more than one switch may couple each inductor 122 to terminal 124. If desired, switches 120 or other switching circuits may be interposed between inductors 122 and terminal 126.

Antenna 40' of FIG. 7 may also have adjustable circuitry such as adjustable circuitry 86 that bridges slot 22. Circuitry 86 may have capacitors 130 or other circuit components that can be selectively switched into or out of use with switching circuitry such as switches 132. If desired, inductors may be coupled in parallel with or instead of capacitors 130. Any desired number of switches 132 may be used. For example, a single switch or more than one switch may couple each capacitor 130 to ground plane 12R-1. If desired, switches 132 or other switching circuits may be interposed between capacitors 130 and ground plane 12R-2.

Parasitic antenna resonating element 90 may be formed over metal structure 78 of planar antenna resonating element 80 (e.g., at a predetermined distance above and not in contact with structure 78). Parasitic antenna resonating element 90 may be coupled to ground 12R-1 via switchable short circuit path 92. A switchable component such as switch 144 may be interposed in path 92 between a first terminal 142 located on parasitic element 90 and a second terminal 140 coupled to ground plane 12R-1. Switch 144 may be selectively switched into or out of use to couple or decouple parasitic element 90 from ground 12R-1. When switch 144 is activated, parasitic element 90 may constructively interfere with the electromagnetic field produced by resonating element 80 to contributed to the overall performance of antenna 40'. When switch 144 is deactivated, parasitic element 90 may have negligible effect on the overall performance of antenna 40'.

Terminal 142 may be located at an edge of parasitic element 90 or elsewhere on element 90. In the example of FIG. 7, terminal 142 of path 92 is located at a corner of element 90. If desired, terminal 140 may be connected to ground portion 12R-2 instead of ground portion 12R-1.

Structure 78 may lie in a plane that is parallel to the plane of ground 12R. Parasitic metal structure 90 may lie in a plane that is parallel to the plane of structure 78. In the example of FIG. 7, planar resonating element structure 78 has a rectangular shape (outline) with lateral dimensions D1 and D2. Dimension D1 may be greater than dimension D2 or dimension D2 may be greater than or equal to dimension D1. Configurations in which structure 78 has a meandering arm shape, shapes with multiple branches, shapes with one or more curved edges, or other shapes may also be used for planar antenna resonating element 80. If desired, parasitic resonating element structure 90 has a rectangular shape with lateral dimensions D3 and D4 (as an example). Dimension D3 may be greater than dimension D4 or dimension D4 may be greater than or equal to dimension D3. Dimension D3 may be less than or equal to dimension D1 whereas dimension D4 is less than or equal to dimension D2. In general, the total area of parasitic element 90 may be less than the total area of element 78. Configurations in which structure 78 has a meandering arm shape, shapes with multiple branches, shapes with one or more curved edges, or other shapes may also be used for planar parasitic element 90. Structures 90 and 78 may have the same outline shape or may have different outline shapes.

In the example of FIG. 7, the entirety of element 90 is located above the projected outline of planar element 78. If desired, some or all of element 90 may be located outside of the projected outline of planar element 78. If desired, parasitic element 90 may lie within a plane that is not parallel to the plane of element 78 and/or element 78 may lie within a plane that is not parallel to the plane of housing surface 12R. The edges of parasitic element 90 may be parallel to the edges of element 78 or may be oriented at angles that are not parallel to the edges of element 78. The edges of elements 90 and 78 may be parallel to the sidewalls 12W of housing 12 or may be oriented at angles that are not parallel to sidewalls 12W.

Figure 8:
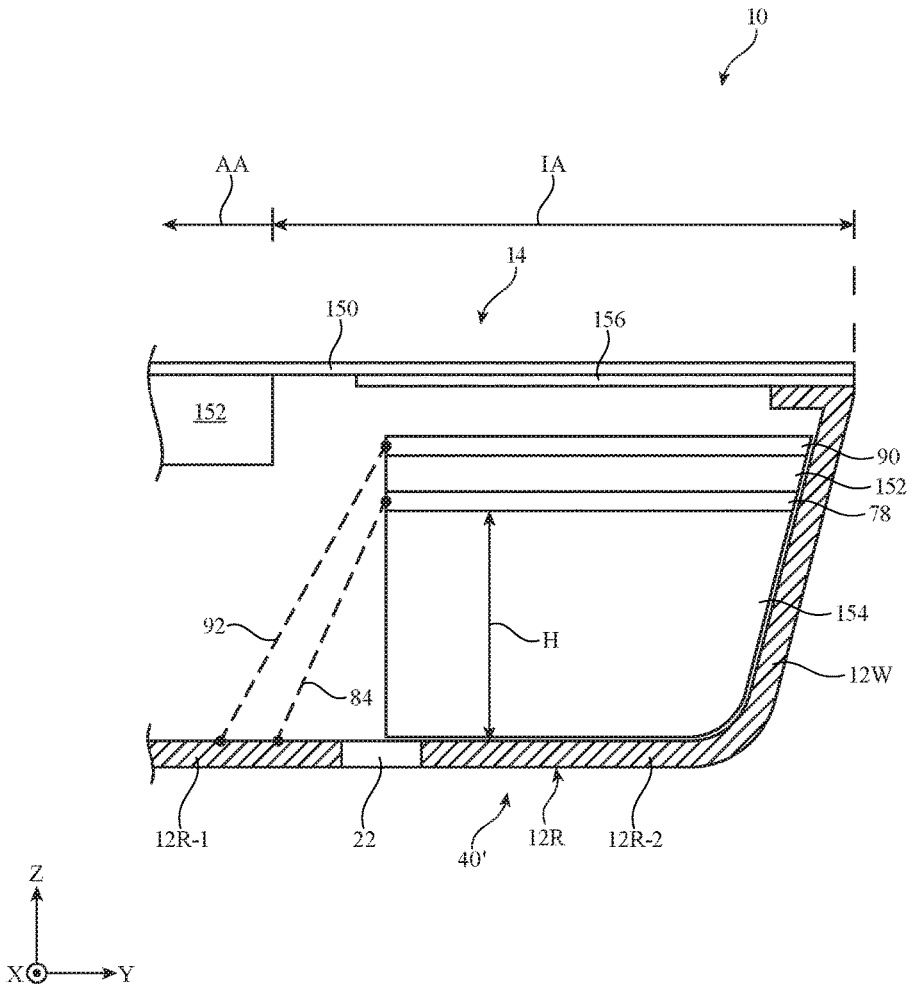
FIG. 8 is a cross-sectional side view showing how a hybrid antenna having a switchable parasitic antenna resonating element may be placed within an electronic device housing in accordance with an embodiment.

Although not shown in FIG. 7 for the sake of clarity, planar antenna resonating element 80 may be formed on a dielectric support structure within device 10. FIG. 8 is a cross-sectional side view of a portion of electronic device 10 showing how antenna 40' may include metal structures formed on a dielectric support structure.

As shown in FIG. 8, electronic device 10 may have a display such as display 14 that has an associated display module 152 and display cover layer 150. Display module 152 may be a liquid crystal display module, an organic light-emitting diode display, or other display for producing images for a user. Display module 152 may include touch sensitive components in scenarios where display 14 is a touch-sensitive display, for example. Display cover layer 150 may be a clear sheet of glass, a transparent layer of plastic, or other transparent member. If desired, display cover layer 150 may form a portion of display module 152. Display cover layer 150 may extend across the entire front face of device 10 if desired.

In active area AA, an array of display pixels associated with display structures such as display module 152 may present images to a user of device 10. In inactive display border region IA, the inner surface of display cover layer 150 may be coated with a layer of black ink or other opaque masking layer 156 to hide internal device structures from view by a user. Antenna 40' may be mounted within housing 12 under opaque masking layer 156. During operation, antenna signals may be transmitted and received through a portion display cover layer 150 and/or through the rear or side of device 10. Forming antenna 40' under inactive region IA of display 14 may allow antenna 40' to transmit and receive radio-frequency signals through display cover layer 150 without the signals being blocked or otherwise impeded by active circuitry in display module 152.

As shown in FIG. 7, planar antenna resonating element structures 78 may be formed on a top surface of a dielectric support structure such as dielectric carrier 154 (e.g., a carrier such as carrier 32 of FIG. 3). Dielectric carrier 154 may be a plastic substrate, foam substrate, ceramic substrate, glass substrate, polymer substrate, or any other desired dielectric substrate. Dielectric carrier 154 may be solid or may enclose a hollow cavity. Planar antenna resonating element structures 78 may be formed from conductive traces patterned directly onto the top surface of dielectric carrier 154, may be formed from sheet metal, conductive foil, or other planar conductors that are placed over or adhered to the top surface of dielectric carrier 154, or may be formed from conductive traces on a rigid or flexible printed circuit board placed on top of dielectric carrier 154.

Dielectric structure 154 may have a height H and may separate resonating element 78 from ground plane 12R-2 by height H. Planar structures 78 may overlap some or all of slot 22 in rear housing wall 12R. Dielectric substrate 154 and planar structures 78 may extend over ground plane portion 12R-2 to sidewall 12W. In another suitable arrangement, other structures may be interposed between substrate 154 and sidewall 12W. Planar structures 78 may be coupled to ground plane 12R-1 on the opposing side of slot 22 via return path 84.

A dielectric layer 152 may be placed on top of planar antenna resonating element structure 78. Layer 152 may be a dielectric such as plastic, ceramic, foam, or other dielectric material. If desired, layer 152 may be formed from adhesive (e.g., pressure sensitive adhesive, thermal adhesive, light cured adhesive, etc.), formed from a rigid or flexible printed circuit, or formed from any other desired structures. If desired, layer 152 may be omitted. Parasitic antenna resonating element 90 may be placed on dielectric layer 152. Parasitic antenna element 90 may be formed from conductive traces patterned directly onto the top surface of dielectric layer 152, may be formed from sheet metal, conductive foil, or other planar conductors that are placed over or adhered to the top surface of dielectric carrier 152 or element 78, or may be formed from conductive traces on a rigid or flexible printed circuit board placed on top of dielectric layer 152 or structure 78. Parasitic antenna element 90 may extend across the entire length of element 78 or may extend across only some of the length of element 78. If desired, parasitic antenna element 90 may extend past the outline of layers 152 and/or 78. Parasitic antenna element 90 may overlap some, all, or none of slot 22 in rear housing wall 12R. Parasitic antenna element 90 may extend over ground plane portion 12R-2 to sidewall 12W or may be separated from sidewall 12W by a gap. Parasitic antenna element 90 may be coupled to ground plane 12R-1 on the opposing side of slot 22 via shorting path 92.

In the example of FIG. 8, carrier 154 has a polygonal cross-sectional shape (e.g., the sides of carrier 154 are substantially planar). This is merely illustrative. If desired, some or all of the sides of carrier 154 may be curved. In general, one or more sides of carrier 154 may conform to (e.g., accommodate, extend parallel to, or abut) the shape of housing sidewall 12W and housing rear wall 12R. The cross section of carrier 154 may have more than four sides if desired. In general, carrier 154, conductors 78 and 90, housing sidewall 12W, and housing rear wall 12R may have any desired shapes or relative orientations.

During operation, antenna 40' may operate in different frequency bands such as a low band LB, midband MB, and high band HB. Antenna 40' may operate in one or more of bands LB, MB, and HB concurrently if desired. Switches 132 (FIG. 7) may be selectively closed or opened to tune antenna 40' in the low band LB. For example, the low band resonance of antenna 40' may be centered on a first frequency in band LB when switch a first switch 132 (e.g., the switch 132 that is farthest from feed 84) is on and the other switches 132 are off, may be centered on a second frequency in band LB that is greater than the first frequency when a second switch 132 (e.g., the second-farthest switch 132 from feed 84) is on and the other switches 132 are off, may be centered on a third frequency in band LB that is greater than the second frequency when a third switch 132 is on and the other switches 132 are off, etc. The adjustable inductor of return path 84 may be used to provide multiple tuning settings for the midband MB if desired.

However, as the area IA available for forming antenna 40' decreases (e.g., to increase the size of active area AA of display 14), the performance (e.g., efficiency and bandwidth) of antenna 40' is typically reduced, particularly in the low band LB. In addition, coupling planar element 78 to ground (e.g., by closing at least one of switches 120) in order to cover frequencies in the midband MB can also limit the efficiency of antenna 40' in the low band LB. If desired, control circuitry 42 may actively control switches 132, 120, and 144 to operate antenna 40' in different tuning or switching modes to improve performance of antenna 40' in the low band LB while also allowing for coverage of frequencies in the midband MB and for further reduction to the size of inactive area IA of display 14.

A table showing how control circuitry 42 may control antenna 40' to operate in different tuning modes is shown in FIG. 9. As shown in FIG. 9, control circuitry 42 may control antenna 40' to operate in first, second, and third tuning modes M1, M2, and M3, respectively. Tuning modes M1, M2, and M3 may sometimes be referred to herein as switching modes, switching states, switching settings, tuning states, or tuning settings.

When controlling antenna 40' to operate in first tuning mode M1, control circuitry 42 may provide control signals that open parasitic switch 144 (e.g., to deactivate or turn off switch 144). Control circuitry 42 may provide control signals that open all of switches 120. This may decouple parasitic antenna element 90 from ground plane 12R-1 so that parasitic element 90 does not significantly perturb (e.g., constructively interfere with) the electromagnetic field generated by planar structure 78 and slot 22. Opening all of switches 120 in tuning mode M1 may decouple planar element 78 from ground plane 12R-1 (e.g., so that element 78 operates as a patch element).

When controlled in this way, patch structure 78 may be directly fed with radio-frequency signals over feed 82. Patch structure 78 may indirectly feed the radio-frequency signals to slot 22. In indirectly feeding slot 22, patch 78 may excite the fundamental frequency (resonance) of slot 22. This fundamental frequency may be a frequency in the low band LB. The low band performance of antenna 40' (e.g., the antenna efficiency and bandwidth in low band LB) may thereby be relatively high when operating in tuning mode M1. Because planar element 82 is decoupled from ground 12R-1, antenna 40' may not exhibit any resonance (or may exhibit negligible or relatively low antenna efficiency) at frequencies outside of the low band LB (e.g., at frequencies in the mid band MB and high band HB). However, decoupling element 78 from ground 12R-1 may allow the efficiency of slot element 22 in low band LB to be greater than would otherwise be possible when element 78 is coupled to ground 12R-1 for relatively small sizes of inactive display area IA.

Control circuitry 42 may, for example, control antenna 40' to operate in first tuning state M1 when it is desired to only cover frequencies in low band LB (e.g., cellular telephone frequencies between 700 and 960 MHz) or when a high efficiency in low band LB is required. If desired, one or more capacitors 130 may be switched into use (e.g., by closing one or more corresponding switches 132) to adjust (shift) the particular frequency within the low band LB that is used. First tuning mode M1 may therefore sometimes be referred to herein as a low-band-only mode or a high performance low band mode.

While operating at frequencies in low band LB, it may be desirable to also cover frequencies in midband MB. For example, it may be desirable to be able to convey signals such as GPS signals at a midband frequency of 1575 MHz or GLONASS signals at a frequency of 1609 MHz while also performing cellular telephone communications at a low band frequency between 760 and 900 MHz. Slot 22 may not exhibit a resonance at frequencies in the midband MB, so indirectly feeding slot 22 using element 78 may be insufficient for covering frequencies in the midband MB. If desired, planar element 78 may be shorted to ground (e.g., by closing one or more of switches 120) to allow planar resonating element structure 78 to resonate at frequencies in the midband MB. However, shorting planar element 78 to ground may degrade or reduce the efficiency of antenna 40' in low band LB, particularly when the distance between active display area AA and sidewall 12W (e.g., the width of inactive area IA) is sufficiently small (e.g., less than 15 mm).

In order to operate at frequencies in low band LB and midband MB, control circuitry 42 may control antenna 40' to operate in second tuning mode M2. In second tuning mode M2, control circuitry 42 may provide control signals that close parasitic switch 144 (e.g., to activate or turn on switch 144). Control circuitry 42 may provide control signals that open all of switches 120. This may couple parasitic antenna element 90 to ground plane 12R-1 so that parasitic element 90 perturbs (e.g., constructively interfere with) the electromagnetic field generated by planar structure 78. Opening all of switches 120 in tuning mode M2 decouples planar element 78 from ground plane 12R-1 (e.g., so that element 78 operates as a patch element without degrading performance in low band LB).

In second tuning mode M2, patch structure 78 may be directly fed with radio-frequency signals over feed 82. Patch structure 78 may indirectly feed the radio-frequency signals to slot 22 to excite the fundamental frequency (resonance) of slot 22 in low band LB. Parasitic element 90 may perturb (e.g., constructively interfere with) the electromagnetic field generated by element 78 in response to being directly fed the radio-frequency signals over feed 82. The constructive electromagnetic field interference generated by parasitic element 90 may establish a resonance for antenna 40' at a frequency in the midband MB (e.g., at a GPS frequency at 1575 MHz).

Because the directly fed patch element 78 remains decoupled from ground in second tuning state M2, the low band performance of antenna 40' (e.g., the antenna efficiency and bandwidth in low band LB) may be relatively high when operating in second tuning mode M2. Coupling parasitic element 90 to ground (e.g., using switch 144) may allow antenna 40' to concurrently exhibit relatively high midband performance (e.g., the antenna efficiency or efficiency bandwidth in midband MB may be relatively high). Antenna 40' may not exhibit any resonance (or may exhibit negligible or relatively low antenna efficiency) at frequencies outside of the low band LB and midband MB (e.g., at frequencies in the high band HB). Control circuitry 42 may, for example, control antenna 40' to operate in second tuning state M2 when it is desired to only cover frequencies in low band LB (e.g., cellular telephone frequencies between 700 and 960 MHz) and midband MB (e.g., GPS frequencies at 1575, cellular frequencies at 1900 MHz, etc.). If desired, one or more of capacitors 130 may be switched into use to adjust the particular frequency within the low band LB that is used. Second tuning mode M2 may sometimes be referred to herein as a GPS mode, a GPS/cellular mode, a low band and midband-only mode, or a high performance low band and midband mode.

When it is desired to operate at frequencies in high band HB (e.g., at cellular telephone frequencies between 2100 MHz and 2700 MHz or at other frequencies that are greater than frequencies in midband MB), control circuitry 42 may control antenna 40' to operate in third tuning mode M3. In third tuning mode M3, control circuitry 42 may provide control signals that open parasitic switch 144. Control circuitry 42 may provide control signals that close at least one of switches 120. This may decouple parasitic antenna element 90 from ground plane 12R-1 so that parasitic element 90 does not affect or constructively interfere with the electromagnetic field generated by planar structure 78. Closing at least one of switches 120 in tuning mode M3 couples (shorts) planar element 78 to ground plane 12R-1 over return path 84 (e.g., so that element 78 operates as a planar inverted-F element).

In third tuning mode M3, planar inverted-F structure 78 may be directly fed with radio-frequency signals over feed 82. Planar structure 78 may indirectly feed the radio-frequency signals to slot 22 to excite the fundamental frequency (resonance) of slot 22 in low band LB. The low band performance of antenna 40' (e.g., the antenna efficiency or efficiency bandwidth in low band LB) may be degraded due to at least one of switches 120 being turned on. The low band performance of antenna 40' may therefore be relatively low when operating in third tuning mode M3. Planar inverted-F structure 78 may exhibit a resonance in the midband MB in response to being directly fed the radio-frequency signals over feed 82. The midband performance of antenna 40' may therefore be relatively high when operating in third tuning mode M3. Control circuitry 18 may selectively close one or more of switches 120 to adjust the particular midband frequency that is used if desired. Planar inverted-F structure 78 may also excite a harmonic frequency (resonance) of slot 22 in third tuning mode M3. This harmonic frequency may be a frequency in the high band HB. The high band performance of antenna 40' (e.g., the antenna efficiency or efficiency bandwidth in high band HB) may thereby be relatively high when operating in tuning mode M3.

Control circuitry 42 may, for example, control antenna 40' to operate in third tuning state M3 when it is desired to only cover frequencies in high band HB (e.g., cellular telephone frequencies between 2100 and 2700 MHz), when it is desired to cover frequencies in midband MB and high band HB, or whenever a relatively high efficiency in the low band LB is not needed. Third tuning mode M3 may sometimes be referred to herein as a multi-band mode, a low band midband high band mode, or a high band mode.

Control circuitry 42 may determine which mode of modes M1, M2, and M3 to use for communications based on any desired criteria. For example, control circuitry 42 may receive instructions from a wireless base station or access point that identify one or more frequencies of operation for device 10. If desired, the current operating state of device 10 may be used to identify frequencies for communications. For example, control circuitry 42 may identify a usage scenario (e.g., whether device 10 is being used to browse the internet, conduct a phone call, send an email, access GPS, etc.) to determine the frequencies for communications. As another example, control circuitry 42 may identify sensor data that is used to identify the frequencies for communications. In general, control circuitry 42 may process any desired combination of this information (e.g., information about a usage scenario of device 10, sensor data, information from a wireless base station, user input, etc.) to identify the desired frequencies for operation.

As an example, if control circuitry 42 determines that device 10 is to convey radio-frequency signals at a frequency in the low band LB only, control circuitry 42 may control antenna 40' to operate in first tuning state M1 or second tuning state M2. If control circuitry 42 identifies that device 10 is to convey radio-frequency signals at a frequency in midband MB only, control circuitry 42 may control antenna 40' to operate in second tuning state M2 or third tuning state M3. If control circuitry 42 identifies that device 10 is to convey radio-frequency signals at a frequency in high band HB (e.g., at a frequency in high band HB only, at a frequency in high band HB and low band LB, at a frequency in high band HB and midband MB, or at a frequency in high band HB, midband MB, and low band LB), control circuitry 42 may control antenna 40' to operate in third tuning state M3. If control circuitry 42 identifies that antenna 40' is to operate in low band LB and midband MB, control circuitry 42 may control antenna 40' to operate in second tuning state M2. Control circuitry 42 may adjust antenna 40' to the desired tuning state prior to beginning communications or may actively update the tuning state of antenna 40' in real time. By switching between tuning states M1, M2, and M3, control circuitry 42 may allow antenna 40' to maintain high efficiency coverage in multiple different communications bands of interest even in scenarios where antenna 40 occupies a relatively small volume (e.g., in scenarios where the width of inactive area IA between active area AA and sidewall 12W is 15 mm or less).

The example of FIG. 9 is merely illustrative. In general, control circuitry 42 may control antenna 40' to exhibit any desired number of tuning states. Each tuning state may alter the performance of antenna 40' in any desired frequency bands of interest.

Figure 10:
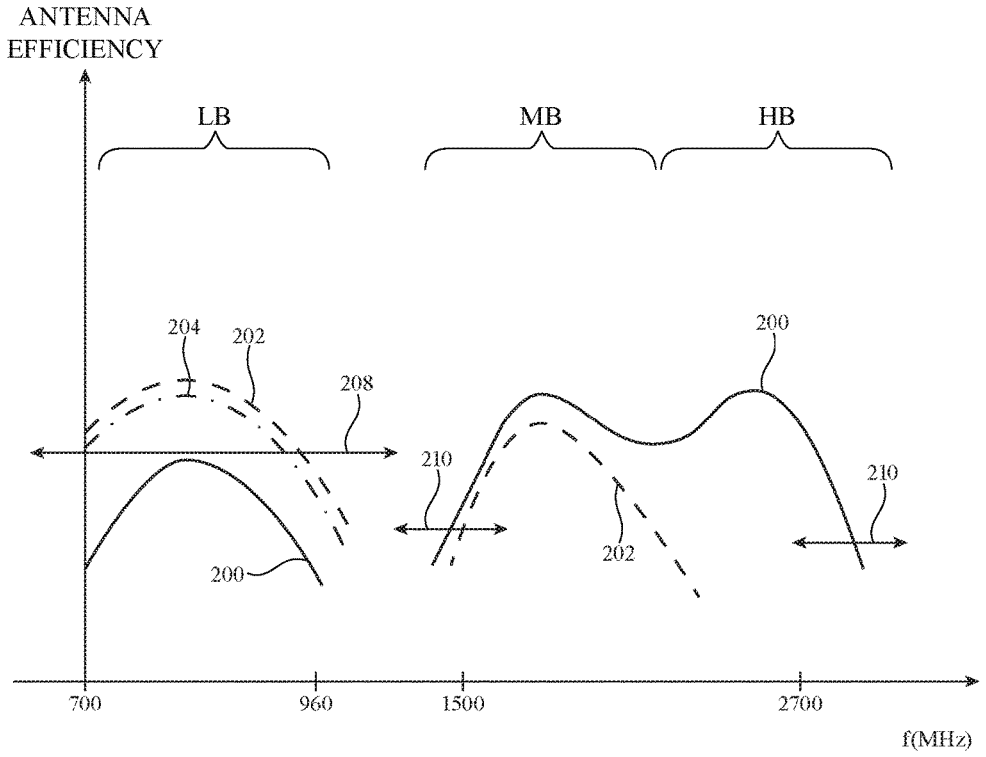
FIG. 10 is a graph of antenna performance (antenna efficiency) plotted as a function of operating frequency for an illustrative antenna of the type shown in FIGS. 6-8 when operated using different tuning circuitry settings in accordance with an embodiment.

FIG. 10 is a graph in which antenna performance (antenna efficiency) has been plotted as a function of operating frequency f. Dashed-dotted curve 204 illustrates the performance of antenna 40' when set to first tuning mode M1 of FIG. 9. Dashed curve 202 illustrates the performance of antenna 40' when set to second tuning mode M2. Solid curve 200 illustrates the performance of antenna 40' when set to third tuning mode M3.

Slot 22 may have a length (e.g., a quarter wavelength) that supports resonances in low communications band LB (e.g., a low band at frequencies between 700 and 760 MHz). When set to first tuning mode M1 or second tuning mode M2, antenna 40' exhibits a relatively high efficiency at a frequency within low band LB. However, due to the active return path between planar metal element 78 and ground 12R-1, antenna 40' may exhibit a relatively low efficiency within low band LB when set to third tuning mode M3 (curve 200). If desired, the particular frequency of operation within low band LB may be tuned by adjusting tunable circuit 86 across slot 22, as shown by arrow 208 (e.g., by selectively enabling at least one of switches 132 in FIG. 7).

Midband coverage (e.g., for midband MB from 1400 or 1500 MHz to 1.9 GHz or another suitable midband range that is greater than low band LB and less than high band HB) may be supported by the resonance exhibited by planar element 78 when operated in tuning state M3 (curve 200) or by the resonance of planar element 78 combined with the field perturbation provided by parasitic element 90 when operated in tuning mode M2 (curve 202). The efficiency of antenna 40' may thereby be relatively high at frequencies in midband MB when operating in second tuning mode M2 or third tuning mode M3. The efficiency of antenna 40' may be relatively low at frequencies in midband MB when operating in first tuning mode M1.

High band coverage (e.g., for a high band centered at 2400 MHz and extending from 1.9 GHz or 2.1 GHz to 2700 MHz or another suitable frequency) may be supported using harmonics of the slot antenna resonating element resonance (e.g., a third order harmonic, etc.) that are excited by planar element 78 when operated in third tuning mode M3. The efficiency of antenna 40' may thereby be relatively high at frequencies in high band HB when operating in third tuning mode M3. The efficiency of antenna 40' may be relatively low at frequencies in high band HB when operating in second tuning mode M2 or first tuning mode M1. If desired, the particular midband frequency and/or the band width of resonance 200 may be tuned by adjusting tunable circuit 84 coupled between planar element 78 and ground 12R-1, as shown by arrows 210 (e.g., by selectively enabling at least one of switches 120 of FIG. 7).

Control circuitry 42 may switch between tuning modes M1, M2, and M3 to provide satisfactory efficiency for antenna 40' in the desired bands of interest (e.g., as is required by the current operating state of device 10, by a corresponding wireless base station, etc.). The example of FIG. 10 is merely illustrative. In general, any desired low band, midband, and high band may be used (e.g., where the midband includes only frequencies greater than the low band and the high band includes only frequencies greater than the midband).

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a metal housing wall that forms a ground plane;

a slot in the metal housing wall that forms a slot antenna resonating element for a hybrid antenna;

a planar antenna resonating element for the hybrid antenna, wherein the planar antenna resonating element is formed over the slot;

an antenna feed having a signal feed terminal coupled to the planar antenna resonating element and a ground feed terminal coupled to the ground plane, wherein the planar antenna resonating element is configured to indirectly feed the slot antenna resonating element;

a parasitic antenna resonating element for the hybrid antenna, wherein the planar antenna resonating element is interposed between the parasitic antenna resonating element and the slot;

a dielectric carrier, wherein the planar antenna resonating element and the parasitic antenna resonating element are supported by the dielectric carrier and the planar antenna resonating element is interposed between the parasitic antenna resonating element and a surface of the dielectric carrier; and control circuitry, wherein the control circuitry is configured to control the hybrid antenna to operate in first and second tuning states, the parasitic antenna resonating element is decoupled from the ground plane and the hybrid antenna is configured to transmit radio-frequency signals in a frequency band in the first tuning state, and the parasitic antenna resonating element is coupled to the ground plane and the hybrid antenna is configured to transmit radio-frequency signals in the frequency band in the second tuning state.

2. The electronic device defined in claim 1, further comprising:

a switch coupled between the parasitic antenna resonating element and the ground plane.

3. The electronic device defined in claim 2, further comprising:

an adjustable inductor coupled between the planar antenna resonating element and the ground plane.

4. The electronic device defined in claim 3, wherein the control circuitry is configured to place the electronic device in the first tuning state by controlling the adjustable inductor to form an open circuit between the planar antenna resonating element and the ground plane and by opening the switch coupled between the parasitic antenna resonating element and the ground plane.

5. The electronic device defined in claim 4, wherein the control circuitry is further configured to place the electronic device in the second tuning state by controlling the adjustable inductor to form the open circuit between the planar antenna resonating element and the ground plane and by closing the switch coupled between the parasitic antenna resonating element and the ground plane.

6. The electronic device defined in claim 5, wherein the slot antenna resonating element is configured to resonate in a low band frequency range while the electronic device is placed in the first and second tuning states and the planar antenna resonating element, the ground plane, and the parasitic antenna resonating element are configured to resonate in a midband frequency range while the electronic device is placed in the second tuning state.

7. The electronic device defined in claim 6, wherein the control circuitry is further configured to place the electronic device in a third tuning state by controlling the adjustable inductor to form a return path between the planar antenna resonating element and the ground plane and by opening the switch coupled between the parasitic antenna resonating element and the ground plane and, when the electronic device is placed in the third tuning state, the slot antenna resonating element is configured to resonate in the low band frequency range and a high band frequency range and the planar antenna resonating element and the ground plane are configured to resonate in the midband frequency range.

8. The electronic device defined in claim 7, wherein the slot antenna resonating element is configured to resonate at a low band frequency in the low band frequency range when the electronic device is placed in the first, second, and third tuning states, the electronic device further comprising:

a switch; and a capacitor coupled in series with the switch between opposing sides of the slot, wherein the control circuitry is configured to control the switch to adjust the low band frequency at which the slot antenna resonating element resonates.

9. The electronic device defined in claim 1, wherein the dielectric carrier is interposed between the antenna resonating element and the metal housing wall, the electronic device further comprising:

a display having a display cover layer, wherein the parasitic antenna resonating element is interposed between the display cover layer and the planar antenna resonating element.

10. The electronic device defined in claim 1, wherein the slot defines first and second opposing sides of the metal housing wall, the dielectric carrier is disposed on the first side, and the ground feed terminal is coupled to the second side, the electronic device further comprising:

a switch coupled between the parasitic antenna resonating element and the second side.

11. The electronic device defined in claim 1, further comprising:

a dielectric layer interposed between the parasitic antenna resonating element and the planar antenna resonating element.

12. An electronic device, comprising:

a metal housing that forms an antenna ground;

a hybrid antenna, comprising:

a slot in the metal housing that forms a slot antenna resonating element;

a planar antenna resonating element;

an antenna feed having a positive feed terminal coupled to the planar antenna resonating element and a ground feed terminal coupled to the antenna ground, wherein the planar antenna resonating element is configured to indirectly feed the slot antenna resonating element; and a parasitic element that is coupled to the antenna ground by a switch; and control circuitry, wherein the control circuitry is configured to control the hybrid antenna to operate in first, second, and third tuning states, wherein the switch is closed in the first tuning state and open in the second and third tuning states, and the hybrid antenna is configured to resonate in a first frequency band and a third frequency band in the first tuning state, in the first frequency band and a second frequency band in the second tuning state, and in the third frequency band in the third tuning state.

13. The electronic device defined in claim 12, further comprising:

an adjustable inductor coupled between the planar antenna resonating element and the antenna ground.

14. The electronic device defined in claim 13, wherein the adjustable inductor comprises switching circuitry and the control circuitry is configured to control the switching circuitry to form an open circuit between the planar antenna resonating element and the antenna ground in the first and third tuning states.

15. The electronic device defined in claim 14, wherein the hybrid antenna is configured to resonate in the first frequency band, the second frequency band, and the third frequency band in the second tuning state, and the switching circuitry in the adjustable inductor forms a return path between the planar antenna resonating element and the antenna ground in the second tuning state.

16. The electronic device defined in claim 15, wherein the first frequency band comprises a first range of frequencies, the second frequency band comprises a second range of frequencies that is greater than the first range of frequencies, and the third frequency band comprises a third range of frequencies that is less than the second range of frequencies.

17. The electronic device defined in claim 13, wherein the slot has opposing first and second sides that are defined by the metal housing, the electronic device further comprising:

adjustable capacitor circuitry coupled between the first and second sides of the slot, wherein the switch is coupled to the antenna ground at the first side of the slot, the adjustable inductor is coupled to the antenna ground at the first side of the slot, and the ground feed terminal is coupled to the antenna ground at the first side of the slot.

18. The electronic device defined in claim 12, further comprising:

an adjustable inductor coupled between the planar antenna resonating element and the antenna ground, wherein the control circuitry is configured to switch the adjustable inductor between at least first and second configurations in the first, second, and third tuning states.

19. An antenna, comprising:

a metal electronic device housing wall that forms an antenna ground;

a slot in the metal electronic device housing wall that forms a slot antenna resonating element;

a parasitic antenna element;

a switching circuit coupled between the parasitic antenna element and the antenna ground;

a planar metal element formed between the parasitic antenna element and the metal electronic device housing wall, wherein the planar metal element forms a planar antenna resonating element, and the planar antenna resonating element is configured to indirectly feed the slot antenna resonating element via nearfield electromagnetic coupling;

a first antenna feed terminal coupled to the planar metal element;

a second antenna feed terminal coupled to the antenna ground; and a tunable component coupled between the planar metal element and the antenna ground, wherein the tunable component forms a return path between the planar metal element and the antenna ground in a tuning setting, the switching circuit is open in the tuning setting, and the slot antenna resonating element, the planar antenna resonating element, and the antenna ground are configured to resonate in at least first and second frequency bands in the tuning setting.

20. The antenna defined in claim 19, wherein the antenna is operable in the tuning setting and first and second additional tuning settings, the tunable component forms an open circuit between the planar metal element and the antenna ground in the first and second additional tuning settings, the switching circuit is open in the first additional tuning setting, the switching circuit is closed in the second additional tuning setting, the slot antenna resonating element is configured to resonate at the first frequency band in the tuning setting and the first and second additional tuning settings, the planar antenna resonating element and the antenna ground are configured to resonate at the second frequency band in the tuning setting, the planar antenna resonating element, the parasitic antenna element, and the antenna ground are configured to resonate at the second frequency band in the second additional tuning setting, and the second frequency band is at least partially higher than the first frequency band.

* * * * *